US005718060A

United States Patent [19]

Mori

[11] Patent Number: 5,718,060

[45] Date of Patent: Feb. 17, 1998

[54] METHOD OF AND APPARATUS FOR CONTROLLING MOISTURE CONTENT OF A WEB PRODUCT AT THE TIME OF CHANGING THE GRADE OF THE WEB PRODUCT ON A PAPER MACHINE

[75] Inventor: Yoshitatsu Mori, Tokyo, Japan

[73] Assignee: New Oji Paper Co., Ltd., Tokyo, Japan

[21] Appl. No.: 615,186

[22] PCT Filed: Aug. 16, 1995

[86] PCT No.: PCT/JP95/01632

§ 371 Date: Apr. 4, 1996

§ 102(e) Date: Apr. 4, 1996

[87] PCT Pub. No.: WO96/05371

PCT Pub. Date: Feb. 22, 1996

[30] Foreign Application Priority Data

Aug. 16, 1994 [JP] Japan ..... 6-192556

[51] Int. Cl.[6] ..... D21F 5/00

[52] U.S. Cl. ..... 34/446; 34/454; 34/117; 34/568

[58] Field of Search ..... 34/445, 446, 448, 34/454, 117, 118, 568, 611, 618; 364/469.01, 471.01, 471.02, 471.03

[56] References Cited

U.S. PATENT DOCUMENTS

| | | | |
|---|---|---|---|
| 2,197,823 | 4/1940 | Young | 34/446 |
| 3,363,325 | 1/1968 | Schie | 34/446 |
| 3,625,812 | 12/1971 | Gudaz | 34/568 X |
| 5,262,955 | 11/1993 | Lewis | 364/471 |
| 5,298,122 | 3/1994 | Munch et al. | 364/471 X |
| 5,377,428 | 1/1995 | Clark | 34/446 |
| 5,379,528 | 1/1995 | Oeschle | 34/446 |
| 5,563,809 | 10/1996 | Williams et al. | 364/469.01 X |

FOREIGN PATENT DOCUMENTS

| | | |
|---|---|---|
| 52-3007 | 1/1977 | Japan . |
| 5-321184 | 12/1987 | Japan . |
| 2-169792 | 6/1990 | Japan . |
| 777131 | 11/1980 | U.S.S.R. . |
| 1416582 | 8/1988 | U.S.S.R. . |

OTHER PUBLICATIONS

John A. Depoy, "Analog Computer Simulation of Paper Drying a Workable Model", Pulp and Paper of Canada, vol. 73, No. 5, pp. 67–74, May 1972.

Hinds, et al., "The Dynamic Computer Simulation of Paper Machine Dryer", Tappi Journal, vol. 66, No. 6, pp. 79–82, (Jun. 1983).

Nissan, et al., "Heat Transfer and Water Removal in Cylinder Drying", Tappi Journal, vol. 43, No. 9, pp. 753–756, (Sep. 1960).

Nissan, et al., "Heat Transfer and Water Removal in Cylinder Drying", Tappi Journal, vol. 45, No. 3, pp. 213–218, (Mar. 1962).

*Primary Examiner*—Hanry A. Bennett
*Assistant Examiner*—Steve Gravini
*Attorney, Agent, or Firm*—Armstrong, Westerman, Hattori, McLeland & Naughton

[57] ABSTRACT

A paper-making process control system is provided for a paper making machine to simulate a web drying operation performed by the drying sections of the paper machine, in order to enhance the reliability of controlling operation in the web product grade change and to reduce the time necessary for the grade change. In the control system, when a web product change is carried out during the paper-making process by passing a web (WE) along with a canvas belt (**14*b*) around a steam-heated drums (14*a*) for the drying of the web (WE), the control system describes heat balance among the steam-heated drums(14*a*), the web (WE), and the canvas belt (14*b*) by heat balance equations on an assumption that there is no temperature differential in the temperature of the circumferential portion of each steam-heated drum (14*a*), and adjustably regulates supply of steam to the respective steam-heated drums (14*a***) on the basis of the heat balance equations to thereby bring a moisture content of the web (WE) to a desired value.

6 Claims, 16 Drawing Sheets

METHOD OF AND APPARATUS FOR CONTROLLING MOISTURE CONTENT OF A WEB PRODUCT AT THE TIME OF CHANGING THE GRADE OF THE WEB PRODUCT ON A PAPER MACHINE

TECHNICAL FIELD

The present invention relates to a method of simulating a steady state moisture content of a web product on a paper machine in which a web (a moist web) along with a canvas belt are passed around the steam-heated drums of a drying section to dry the web, and an apparatus for carrying out the above-mentioned method. More specifically, the present invention relates to a method of simulating the effect of varying the pressure of steam supplied to steam-heated drums of a paper machine on the moisture content of a web product during an unsteady transferring state in the paper producing process in which a moist web and a canvas belt are fed around steam-heated drums in the paper machine to obtain the dried web product, and an apparatus for carrying out the method.

The present invention also relates to a method of controlling the moisture content of a web so that the moisture content of the web is adjusted to a desired moisture content when a grade of a web product on a paper machine, in which a moist web along with a canvas belt are passed around steam-heated drums thereof to dry the web, should be changed from one web product grade to a different web product grade, and a control apparatus for carrying out such method.

BACKGROUND ART

As is generally known, a typical paper machine has a wire section, a press section, a predrying section, a sizing section, and an afterdrying section. The wire section includes an endless wire belt, and a stock inlet unit is disposed at the receiving end of the wire section. Paper stock, i.e., pulp, is discharged from the stock inlet unit into the wire section. Water contained in the paper stock is drained in the wire section to form a web. The web is delivered from the wire section to the press section and the web is further drained of water in the press section, and then the web is delivered, as a moist web, to the predrying section. A plurality of steam-heated drums are arranged in the predrying section and are heated by steam supplied thereto. The moist web is wound sequentially around the steam-heated drums of the predrying section and is dried by the steam-heated drums to a predetermined moisture content. Subsequently, the web is subjected to a sizing process in the sizing section, and then the sized web is further dried to have a predetermined moisture content while the sized web passes through the afterdrying section. The construction and arrangement of the afterdrying section are substantially the same as that of the predrying section. After being thus dried in the afterdrying section, the web is taken up in a roll as a final product.

The basis weight and the moisture content of the web must be measured at the outlet of the afterdrying section and the paper stock discharge rate at which the paper stock is discharged into the wire section and the steam pressures in the steam-heated drums must be controlled on the basis of measured data. Such control operations are carried out by a basis weight and moisture measuring system (hereinafter referred to as "BM measuring system"). The BM measuring system is provided with measuring units disposed just behind the predrying section and the afterdrying section, respectively, and a control unit for processing data provided by the respective measuring units. In short, paper stock discharge rate at which the paper stock is discharged into the wire section, the pressure of the steam supplied to the steam-heated drums and such are controlled on the basis Of the data provided by the measuring units, i.e., the basis weight and the moisture content of the web, the web speed of the paper machine, and such, to produce a web having uniform quality.

A paper-making process condition control function to control a change in the grade of a web product from one to a different grade is one of the control functions of the BM measuring system. Namely, according to the paper-making process condition control function, the control unit changes, while the paper machine is operating continuously, paper-making process conditions, including paper stock discharge rate and the pressure of the steam, after the completion of a paper-making process for producing a web of, for example, a given basis weight and another paper-making process for producing a web of another basis weight is started. Although the steam pressure for the steam-heated drums, the web speed and such are changed greatly when changing process conditions for one paper-making process to those for another, i.e, when changing the grade of the web product from one to another, the steam pressure for the steam-heated drums and such are predicted on the basis of accumulated measured data by using a simple predictive equation and the paper-making process conditions are controlled according to estimated values to change the process conditions for the preceding paper-making process to those for the succeeding paper-making process; that is, the steam pressure for the steam-heated drums of the predrying section are regulated properly so that the moisture content of a web of a new basis weight immediately after drying by the predrying section is adjusted to a desired moisture content, and the steam pressure for the steam-heated drums of the after-drying section are controlled properly so that the moisture content of the web immediately after drying by the afterdrying section is adjusted to a desired moisture content.

Incidentally, the web produced during a transient paper-making operation between the preceding paper-making process to the succeeding paper-making process, i.e., during a period in which the paper-making process conditions are varied (the grade of web product is changed) is a substandard web, i.e., a waste web. Therefore, the time necessary for changing paper-making process conditions must be reduced to the least possible extent to improve the production efficiency of the paper machine. Nevertheless, paper-making process condition control by the conventional BM measuring system is unable to achieve satisfactory moisture content control for all the cases of paper-making process condition change. The unsatisfactory moisture content control is considered to be due to the paper-making process condition control based on empirical predictive equations not theoretically substantiated and the control of the paper-making process conditions in the transient paper-making process condition changing period by an unestablished method. Although the paper-making process condition control can be accomplished successfully in a comparatively short time, the paper-making process condition control takes a comparatively long time in most cases under the existing circumstances The mode of drying of the web while the web is being dried by the steam-heated drums of the predrying section and the afterdrying section can be predicted by simulation using an appropriate model of paper drying, and the pressure of steam to be supplied to the steam-heated drums necessary to dry the web of a new basis weight in a desired moisture content can be determined by calculating based on the results of simulation of the mode of paper drying. Methods of calculating steam pressure on the basis of results of simulation are explained in the following papers.

1. John A. Depoy, "Analog Computer Simulation of Paper Drying a Workable Model", PULP AND PAPER OF CANADA, Vol. 73, No. 5, p. 67 (May, 1972)

2. Jeffery A. Hinds, et al., "The Dynamic Computer Simulation of Paper Machine Dryer", Tappi Journal, Vol. 66, No. 6, p. 79, (June, 1983)

3. A. H. Nissan, et al., "Heat Transfer and Water Removal in Cylinder Drying", Tappi Journal, Vol. 43, No. 9 (Sept., 1960)

The known method of simulation using a model of paper drying, however, must repeat a convergent calculation to determine the temperatures of the steam-heated drums and hence takes several minutes to calculate the temperatures of the steam-heated drums even if a high-speed computer (an EWS or the like) is used for the calculation. Accordingly, it is difficult to practically apply the aforesaid methods of simulation to the predictive calculation and the control of paper-making process conditions.

DISCLOSURE OF THE INVENTION

Accordingly, a principal object of the present invention is to provide a reliable method of controlling the moisture content of a web, during a paper-making process, which is capable of reducing the time necessary for changing paper-making process conditions, i.e., the time necessary for changing the grade of a web product, to the least possible extent, and a control apparatus for carrying out the method.

Another object of the present invention is to provide a method of controlling the moisture content of a web which is capable of reducing the amount of substandard web in producing the web by a paper-making process on a paper machine, and a control apparatus for carrying out the method.

In accordance with a first aspect of the present invention, there is provided a steady-state simulation method for simulating the moisture content of a web on a paper machine at a steady state during a paper drying process in which a moist web, along with a canvas belt, is passed around steam-heated drums of steam-heated drum drying sections of the paper machine to obtain a dried web product. An apparatus for carrying out the steady-state simulation method is also provided.

When carrying out steady-state simulation, heat balance among the steam-heated drums of the steam-heated drum sections, the web, and the canvas belt is described by heat balance equations on an assumption that a temperature distribution in the circumference portion of the respective steam-heated drums is uniform, and the heat balance equations are reduced to difference equations. Initial values for the elements of the difference equations are given, and the difference equations are solved repeatedly at given intervals to determine a moisture content transition pattern with respect to a direction of travel of the web in the paper machine through the calculation of the respective temperatures of the steam-heated drums, the canvas belt and the web. The final moisture content indicated on the moisture content transition pattern is compared with an actually measured moisture content to detect whether or not the final moisture content is within a given allowance with respect to the actually measured moisture content. If the final moisture content is outside the limits of the allowance, a web-to-ambient mass transfer coefficient is corrected, and another moisture content transition pattern is calculated. This procedure is repeated until the final moisture content falls within the given allowable range.

In accordance with another aspect of the present invention, there is provided an unsteady-state simulation method for simulating a moisture content of a web at an unsteady state in a paper making process in which a moist web, along with a canvas belt, is passed around the steam-heated drums of steam-heated drum drying sections to dry the web, and steam pressure supplied to the steam-heated drums of the steam-heated drum drying section of the paper machine is varied. An apparatus for carrying out the unsteady-state simulation method is also provided.

When carrying out unsteady-state simulation, the heat balance between the steam-heated drums of the steam-heated drum section, the web, and the canvas belt is described by heat balance equations on an assumption that a temperature distribution in a circumference portion of each of the respective steam-heated drums is uniform, and the heat balance equations are reduced to difference equations. The difference equations are solved repeatedly, taking into consideration response time of the temperature of the steam-heated drum when a steam pressure is varied, at a given time period to determine a moisture content transition pattern with respect to a direction of travel of the web in the paper machine.

In accordance with a further aspect of the present invention, there is provided a transient moisture content control method for adjusting a moisture content of a web product on a paper machine in which the web, along with a canvas belt, is passed around the steam-heated drums of steam-heated drum drying sections to dry the web to a desired moisture content by controlling the steam pressures of the steam-heated drums when a web product grade is changed from one grade to a different grade, and an apparatus for carrying out the transient moisture content control method is also provided.

When carrying out the transient moisture content control method, heat balance among the steam-heated drums of the steam-heated drum section, the web, and the canvas belt is described by heat balance equations on an assumption that a temperature distribution in the circumference of each of the steam-heated drums is uniform, and the heat balance equations are reduced to difference equations. Initial values for the elements of the difference equations are given, and the difference equations are solved to determine a moisture content transition pattern with respect to a direction of travel of the web in the paper machine and a desired moisture content transition pattern is determined. A temporal steam pressure transition pattern is produced by varying the steam pressure supplied to the steam-heated drums in a given time period and the moisture content transition pattern is calculated repeatedly taking into consideration an assumed time lag in the response of the temperature of the steam-heated drums to make the moisture content transition pattern coincide substantially with a desired moisture content transition pattern. When changing the paper-making process conditions of the paper machine, i.e., when the web product grade is changed from one to a different grade, steam pressure for the steam-heated drums is regulated on the basis of the steam pressure transition pattern.

As mentioned above, according to the present invention, the temperatures of the steam-heated drums are calculated by using the heat balance equations describing the heat balance among the web, the steam-heated drum and the canvas belt, on an approximate assumption that a temperature in the circumference of each steam-heated drum is fixed, i.e., an assumption that there is no temperature differential among every portions of the circumference of each steam-heated drums. Consequently, the above-mentioned calculation can be quickly accomplished.

BRIEF DESCRIPTION OF THE DRAWINGS

The above and other objects, features and advantages of the present invention will be described with reference to the accompanying drawings, in which.

BEST MODE OF CARRYING OUT THE INVENTION

A paper-making process condition control apparatus according to a preferred embodiment of the present invention will be described hereinafter.

Figure 1:
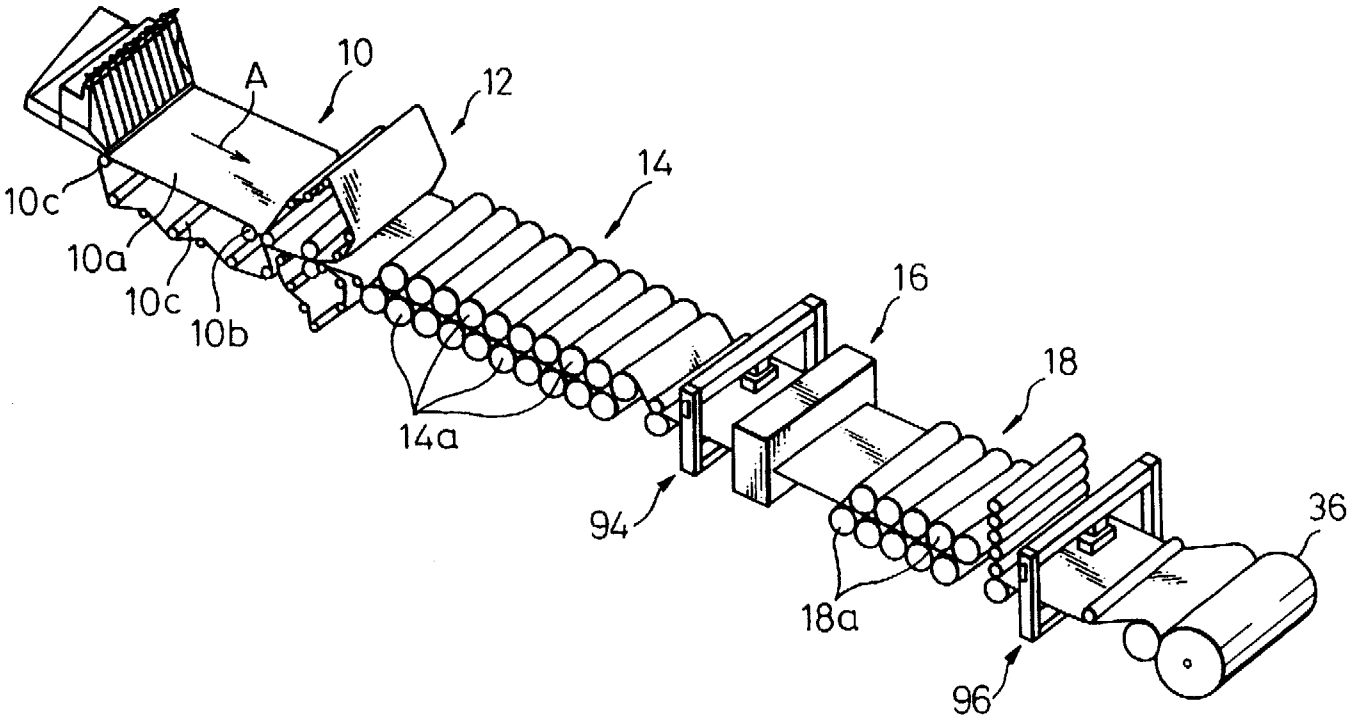
FIG. 1 is a schematic perspective view of a paper machine for carrying out the present invention.
Figure 2:
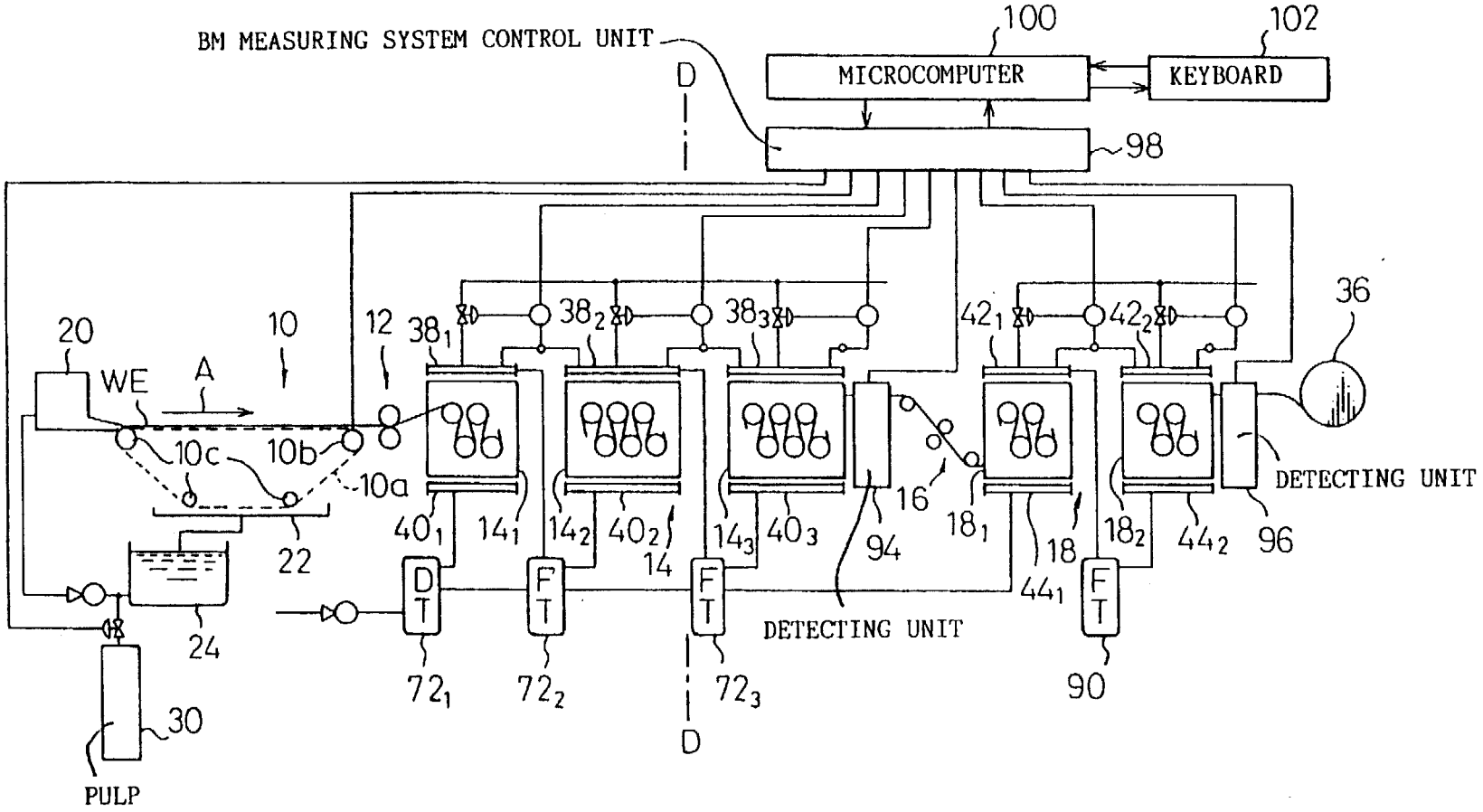
FIG. 2 is a block diagram of a paper machine incorporating the present invention therein.

FIG. 1 shows a representative paper machine, and FIG. 2 is a block diagram of the paper machine provided with a paper-making process condition control apparatus embodying the present invention.

Figure 3:
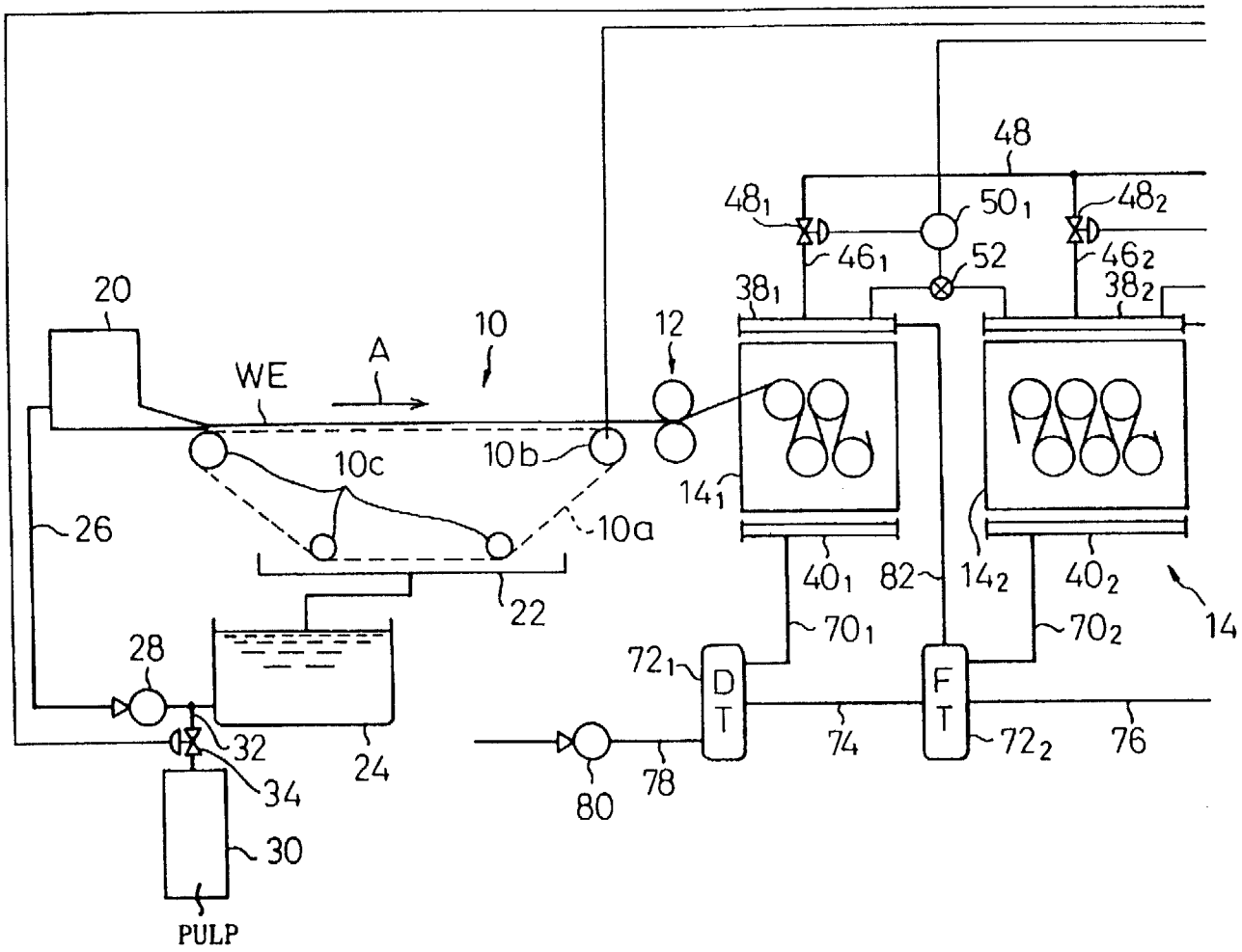
FIG. 3 is an enlarged block diagram of the left half section of the paper machine of FIG. 2 on the left side of division line D—D in FIG. 2.
Figure 4:
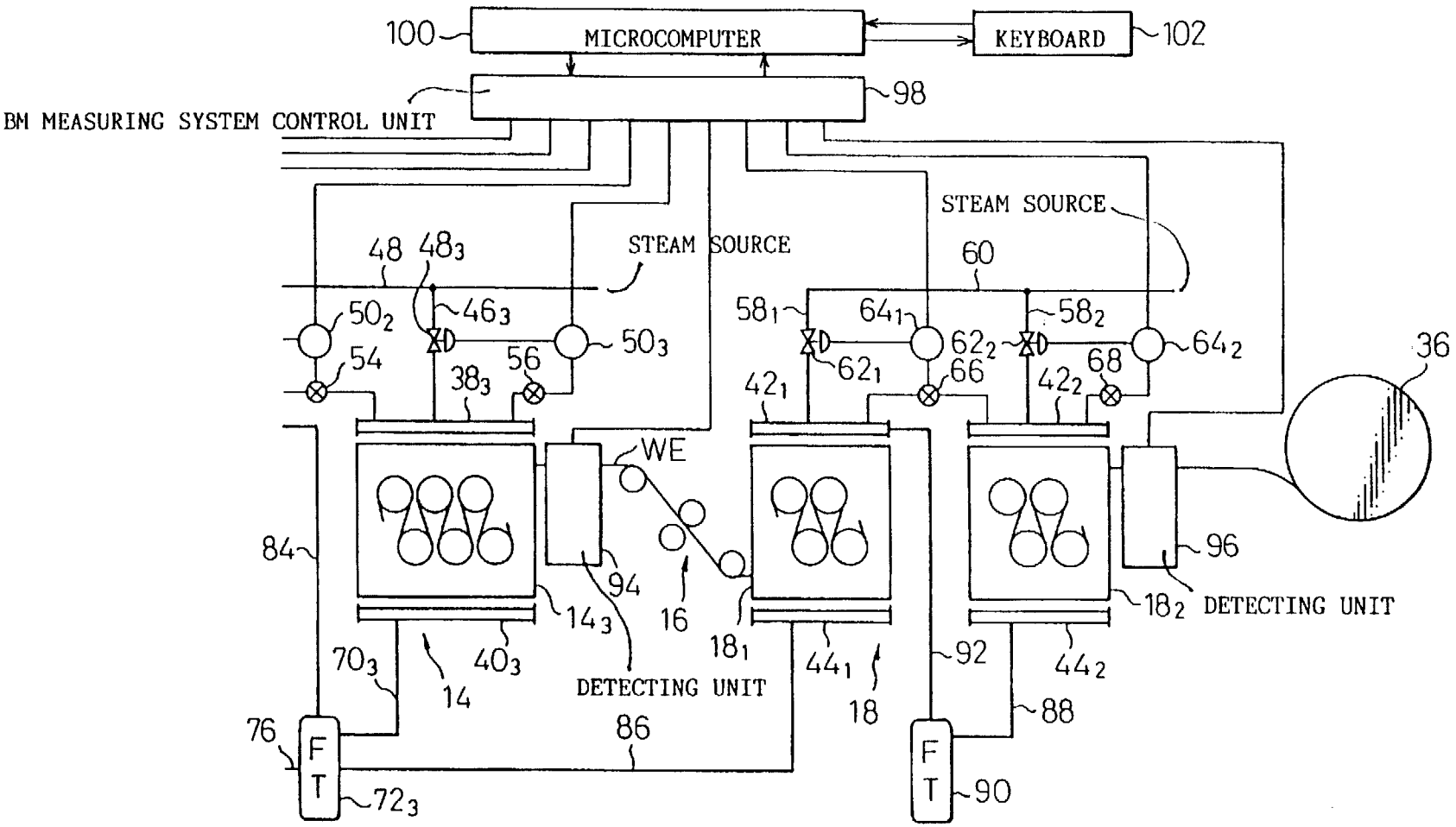
FIG. 4 is an enlarged block diagram of the right half section of the paper machine of FIG. 2 on the right side of division line D—D in FIG. 2.

FIGS. 3 and 4 are enlarged fragmentary views of the paper machine of FIG. 2, showing the left half section of the paper machine of FIG. 2 on the left side of division line D—D in FIG. 2, and the right half section of the same paper machine on the right side of division line D—D, respectively.

Referring to FIGS. 1 to 4, the paper machine has a wire section 10, a press section 12, a predrying section 14, a sizing section 16 and an afterdrying section 18.

The wire section 10 comprises an endless wire belt **10*a* wound around a drive roller 10*b* and a plurality of guide rollers 10*c* properly arranged relative to the drive roller 10*b*. The drive roller 10*b* is driven for rotation by an appropriate drive motor, not shown, to turn the wire belt 10*a* so that the upper side of the endless wire belt 10*a* moves in the direction of the arrows A shown in FIGS. 1, 2 and 3. A stock inlet unit 20 is disposed at the receiving end of the endless wire belt 10*a* to discharge pulp slurry, i.e. paper stock, onto the upper side of the endless wire belt 10*a*. The pulp slurry is drained of water on the upper side of the endless wire belt 10*a* to form a web WE on the upper side of the endless wire belt 10*a* (FIGS. 1, 2 and 3). The water drained from the pulp slurry to form the web WE is called white water containing pulp in a low concentration. The white water is collected through a trough 22 (FIGS. 2 and 3) extended under the wire section 10 in a white water pit 24. The white water pit 24 is connected to the stock inlet unit 20 by a line 26 provided with an appropriate pump 28. A pulp supply line 32 has one end connected to a pulp supply pipe unit 30 and the other end connected to the line 26 at a position between the white water pit 24 and the pump 28. The pulp supply line 32 is provided with an appropriate valve 34. The opening of the valve 34 is regulated while the pump 28 is in operation to regulate the pulp concentration of the pulp slurry supplied to the stock inlet unit 20**.

The web "WE" formed in the wire section 10 is further drained of water in the press section 12 to a moisture content on the order of 60%. Subsequently, the web "WE" is delivered to the predrying section 14. The predrying section 14 has an arrangement of a plurality of steam-heated drums **14*a* heated by steam supplied thereto. The web "WE" is passed sequentially through the steam-heated drums 14*a* of the predrying section 14 while being in close contact therewith to dry the web "WE" in a predetermined moisture content. Then, the web "WE" is subjected to a sizing process in the sizing section 16, and the sized web "WE" is transferred to the afterdrying section 18. The afterdrying section 18 is substantially the same in construction as the predrying section 14. The web "WE" is dried in a predetermined moisture content while the same is passed through the afterdrying section 18. The web "WE" thus dried by the afterdrying section 18 is taken up in a web roll 36**.

The drying section 14 (18) will be described in detail with reference to FIG. 5.

An endless canvas belt **14*b* (18*b*) is passed around steam-heated drums 14*a* (18*a*), and the web "WE" is passed along with the canvas belt 14*b* (18*b*) through the steam-heated drums 14*a* (18*a*). In the example shown in FIG. 5, the drying section 14 (18)** has both a single-canvas drying structure, i.e., a structure on the left side in FIG. 5, and a double-canvas drying structure, i.e., a structure on the right side in FIG. 5.

Figure 5:
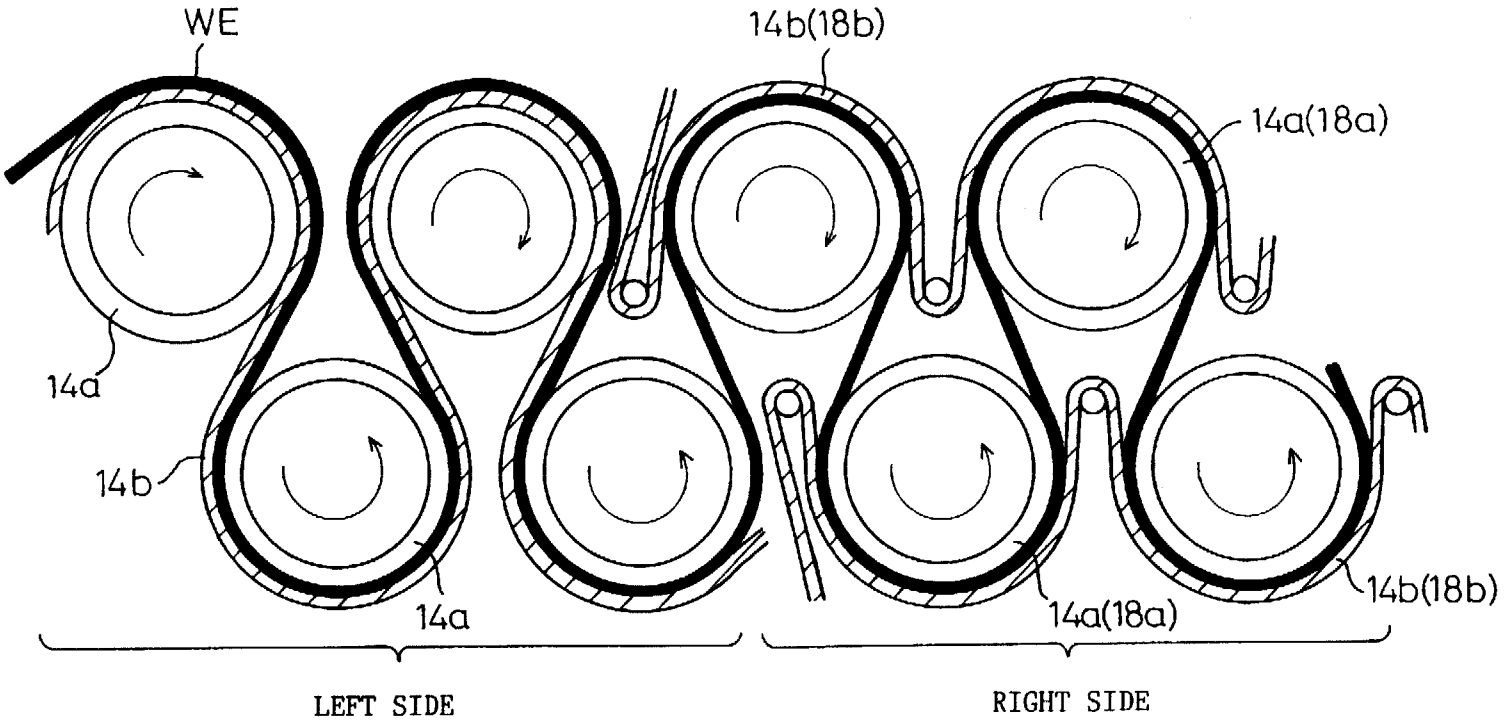
FIG. 5 is a fragmentary side view of a drying section included in a paper machine.

In FIG. 5, the arrows marked on the steam-heated drums **14*a* (18*a*) indicates the respective directions of rotation of the corresponding steam-heated drums 14*a* (18*a*)**.

In FIG. 1, the number of the steam-heated drums **14*a* of the predrying section 14 is twenty for convenience sake, the predrying section 14 may be provided with more than twenty steam-heated rollers. In this embodiment, the steam-heated drums 14*a*** are divided into those of a first drying unit $14_1$, those of a second drying unit $14_2$ and those of a third drying unit $14_3$ as shown in FIGS. 2, 3 and 4. A common steam supply header $38_1$ and a common drain header $40_1$ are connected to the steam-heated drums 14*a* of the first drying unit $14_1$. Similarly, common steam supply headers $38_2$ and $38_3$, and common drain headers $40_2$ and $40_3$ are connected to the steam-heated drums 14*a* of the second drying unit $14_2$ and the third drying unit $14_3$, respectively. The steam-heated drums 18*a* of the afterdrying section 18 are divided into those of a first drying unit $18_1$ and a second drying unit $18_2$.

A common steam supply header $42_1$ and a common drain header $44_1$ are connected to the steam-heated drums 18*a* of the first drying unit $18_1$ and, similarly, a common steam supply header $42_2$ and a common drain header $44_2$ are connected to the steam-heated drums 18*a* of the second drying unit $18_2$.

As best shown in FIGS. 3 and 4, lines $46_1$, $46_2$ and $46_3$ connected to the steam supply headers $38_1$, $38_2$ and $38_3$, respectively, are connected to a main steam supply line 48, which, in turn, is connected to a steam generator, not shown. The lines $46_1$, $46_2$ and $46_3$ are provided with valves $48_1$, $48_2$ and $48_3$, and valve controllers $50_1$, $50_2$ and $50_3$ are incorporated into the valves $48_1$, $48_2$ and $48_3$, respectively. A differential pressure sensor 52 for detecting the difference in steam pressure between the steam supply headers $38_1$ and $38_2$ is provided in a line having one and the other end connected to the steam supply headers $38_1$ and $38_2$. The differential pressure sensor 52 is connected to the valve controller $50_1$. Similarly, a differential pressure sensor 54 for detecting the difference in steam pressure between the steam supply headers $38_2$ and $38_3$ is provided in a line having one and the other end connected to the steam supply headers $38_2$ and $38_3$. The differential pressure sensor 54 is connected to the valve controller $50_2$. A pressure sensor 56 is connected to the steam supply header $38_3$ to detect the steam pressure of the steam supply header $38_3$. The pressure sensor 56 is connected to the valve controller $50_3$. Lines $58_1$ and $58_2$, connected to the steam supply headers $42_1$ and $42_2$, respectively, are connected to a main steam supply line 60, which, in turn, is connected to the steam generator, not shown. The lines $58_1$ and $58_2$ are provided with valves $62_1$ and $62_2$, and valve controllers $64_1$ and $64_2$ are incorporated into the valves $62_1$ and $62_2$, respectively. A differential pressure sensor 66 for detecting the difference in steam pressure between the steam supply header $42_1$ and $42_2$ is provided in a line having one end connected to the steam supply headers $42_1$ and the other end connected to the steam supply header $42_2$. The differential pressure sensor 66 is connected to the valve controller $64_1$. A pressure sensor 68 is connected to the steam supply header $42_2$ to detect the pressure of the steam supply header $42_2$. The pressure sensor 68 is connected to the valve controller $64_2$.

A line $70_1$ extending from the drain header $40_1$ is connected to a flash tank $72_1$. Similarly, lines $70_2$ and $70_3$ extending from the drain headers $40_2$ and $40_3$, respectively, are connected to flash tanks $72_2$ and $72_3$, respectively.

As best shown in FIGS. 3 and 4, the flash tanks $72_1$, $72_2$ and $72_3$ are connected in series by lines 74 and 76. The flash tank $72_1$ is connected to a drain pump 80 by a line 78. The flash tank $72_2$ is connected to the steam supply header $38_1$ by a line 82, and the flash tank $72_3$ is connected to the steam supply header 38 by a line 84. A line 86 extending from the drain header $44_1$ is connected to the flash tank $72_3$. A line 88 extending from the drain header $44_2$ is connected to a flash tank 90. The flash tank 90 is connected to the steam supply header $42_1$ by a line 92.

In the paper machine, the basis weight and the moisture content of the web must be measured at positions just behind the predrying section and the afterdrying section, and pulp slurry discharge rate at which the pulp slurry is discharged into the wire section, the steam pressure for the steam-heated drums, and web speed must be controlled on the basis of the measured data. As mentioned above, these operations can be achieved by incorporating a well-known BM measuring system into the paper machine.

The BM measuring system comprises a first detecting unit 94 disposed just behind the predrying section 14, a second detecting unit 96 disposed just behind the afterdrying section 18, and a BM control unit 98 for processing the detection data provided by the detecting units 94 and 96 and for controlling the operations of the paper machine.

The first detecting unit 94 measures the basis weight and the moisture content of the web "WE" immediately after the web "WE" has been passed through the predrying section 14, and the second detecting unit 96 measures the basis weight and the moisture content of the web "WE" immediately after the web "WE" has passed through the afterdrying section 18. As can be seen from FIGS. 3 and 4, the valve 34 provided for the pulp supply pipe unit 30 is connected to the BM control unit 98, and the opening of the valve 34 is adjustably changed by a control signal provided by the BM control unit 98 to control the pulp concentration of the pulp slurry supplied to the stock inlet unit 20; that is, the BM control unit 98 regulates the opening of the valve 34 to control the basis weight of the web "WE". The BM control unit 98 sends a control signal to the drive motor for driving the drive roller 10*b* for driving the endless wire belt 10*a* of the wire section 10 and to control the web speed. The controllers $50_1$, $50_2$ and $50_3$ associated with the first drying unit $14_1$, the second drying unit $14_2$ and the third drying unit $14_3$ of the predrying section 14, and the controllers $64_1$ and $64_2$ associated with the first drying unit $18_1$ and the second drying unit $18_2$ of the afterdrying section 18 are connected to the BM control unit 98. The BM control unit 98 sends control signals to the controllers $50_1$, $50_2$, $50_3$, $64_1$ and $64_2$ to control the steam pressures of the steam-heated drums 14*a* and 18*a* by opening and closing the corresponding valves.

The controllers $50_1$, $50_2$, $50_3$, $64_1$ and $64_2$ are controlled on the basis of steam pressure data provided by the corresponding sensors 52, 54, 56, 66 and 68, respectively.

In short, the BM control unit 98 processes the detection data (basis weight and the moisture content of the web) provided by the first detecting unit 94 and the second detecting unit 96, and controls the pulp slurry discharge rate at which the pulp slurry is discharged into the wire section 10 and the steam pressures of the steam-heated drums 14*a* and 18*a* of the drying units $14_1$, $14_2$, $14_3$, $18_1$ and $18_2$, on the basis of data obtained by processing the detection data, to produce a web of a predetermined quality.

The foregoing paper machine and the control procedure for controlling the operations of the paper machine are well-known. The present invention provides a paper-making process condition control apparatus, i.e., a web product grade control apparatus, capable of controlling such a paper machine so that the paper machine is able to accomplish a grade changing operation of a web product quickly and in a short time.

Figure 6:
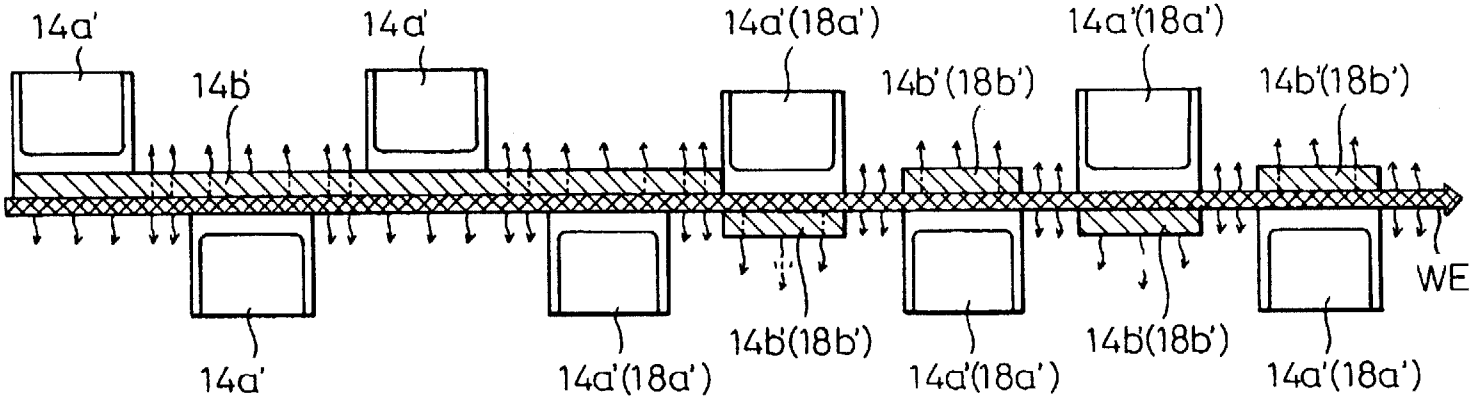
FIG. 6 is a typical view of a hot plate model equivalent to the drying section of FIG. 5.

A paper-making process condition apparatus or a grade change control apparatus in accordance with the present invention uses a hot plate model as shown in FIG. 6, which is equivalent to the drying section shown in FIG. 5, for controlling the web product grade changing operation of the paper machine. In FIG. 5, the web WE is dried by the steam-heated drums 14a (18a) as the same is passed around the steam-heated drums 14a (18a) along with the canvas belt 14b (18b), which is equivalent to drying the web "WE" as the same is passed through a path defined by hot plates 14a' (18a') fixedly disposed at given intervals and canvas sheets 14b' (18b') properly combined with the hot plates 14a' (18') as shown in FIG. 6. In short, segments in FIG. 5 in which heat is transferred from the steam-heated drums 14a (18a) through the canvas belt 14b (18b) to the web "WE" corresponds to segment in FIG. 6 in which heat is transferred from the hot plates 14a' (18a') through the canvas sheets 14b' (18b') to the web "WE", and segments in FIG. 5 in which heat is transferred directly from the steam-heated drums 14a (18a) to the web "WE" corresponds to segments in FIG. 6 in which heat is transferred directly from the hot plates 14a' (18a') to the web "WE". Sections in which no heat is transferred from the hot plates 14a' (18a') to the web "WE" are called free-run segments. In this example, the free-run segments include those in which the web "WE" and the canvas sheet 14b' (18b') are superposed and those in which the web "WE" travels alone. The arrows in FIG. 6 indicate mode of evaporation of moisture from the web "WE".

Heat balances existing in the steam-heated drum 14a' (18a'), the canvas belt 14b (18b) and the web "WE" are expressed by the following equations.

Steam-heated Drum:

$$(L_D \cdot \rho_D \cdot C_D) \cdot dT_1/dt = [h_s \cdot (T_S - T_1) - h_{DW} \cdot (T_1 - T_2)] \quad (1)$$

Web:

$$(L_W \cdot \rho_W \cdot C_W) \cdot dT_2/dt = [h_{DW} \cdot T_1 - (h_{DW} + h_{WF}) \cdot T_2 + h_{WF} \cdot T_3 - V \cdot K \cdot (P_W - P_{ad}) \cdot H] \quad (2)$$

Canvas Sheet:

$$(L_F \cdot \rho_F \cdot C_F) \cdot dT_3/dt = [h_{WF} \cdot T_2 - (h_{WF} + h_a) \cdot T_3 + h_a \cdot T_a] \quad (3)$$

Parameters used in Equations (1), (2) and (3) are as shown below.

$L_D$: Wall thickness of heated drums (m)

$L_W$: Thickness of web (m)

$L_F$: Thickness of canvas (m)

$T_S$: Steam temperature in heated drum (°C.)

$T_a$: Air temperature (°C.)

$T_1$: Representative temperature of drum (°C.)

$T_2$: Representative temperature of web (°C.)

$T_3$: Representative temperature of canvas (°C.)

$C_D$: Specific heat of drum ( kcal/kg·°C.)

$C_w$: Specific heat of web (kcal/kg·°C.)

$C_F$: Specific heat of canvas (kcal/kg·°C.)

$\rho_D$: Density of drum (kg/m$^3$)

$\rho_W$: Density of web (kg/m$^3$)

$\rho_F$: Density of canvas (kg/m)

$h_S$: Heat transfer coefficient between steam in drum and the inner surface of drum (kcal/m$^2$·sec·°C.)

$h_{Dw}$: Heat transfer coefficient between the outer surface of drum and web (kcal/m·sec·°C.)

$h_{wF}$: Heat transfer coefficient between web and canvas (kcal/m$^2$·sec·°C.)

$h_a$: Heat transfer coefficient between canvas and the atmosphere (kcal/m$^2$·sec·°C.)

V: Evaporative factor (–)

Evaporative factor is a nondimensional parameter, such as constant-rate drying correction factor or a falling-rate drying correction factor, indicating evaporation rate dependent on the moisture content of the web.

K: Web-to-ambient mass transfer coefficient ($H_2O$ kg/kg·Hr·)

$P_W$: Saturation vapor pressure of water at web temperature (kg/m$^2$)

$P_{ad}$: Saturation vapor pressure of water at the wet-bulb temperature of the ambient air (kg/m$^2$)

H : Heat of evaporation of water (kcal/$H_2O$)

The above Equation (1) is based on a condition that the rate of change of heat stored in the drum (the drum material) with time is equal to the difference between heat that flows from the steam in the drum to the drum material and the heat that flows out from the drum material, which applies also to Equations (2) and (3).

Incidentally, the temperature of an optional point on the circumference of the steam-heated drum of a steam dryer drops when the point comes into contact with the web and rises after the point has separated from the web.

When determining the temperature of a drum by conventional simulation, an initial value is assigned to such an optional point, temperature variations are calculated at a given period, the calculated temperature of the point after the drum has turned one full turn is compared with the initial value, the same calculations are repeated using the calculated temperature as an initial value, and it is decided that the temperature of the drum is obtained upon the coincidence of the calculated temperature and the initial value. The conventional simulation using such a convergent calculation takes a very long time, and several minutes is necessary for calculating the temperatures of all the steam-heated drums even if a high-speed electronic computer, such as an EWS, is used. Accordingly, it has been difficult to estimate the moisture content of the web and to achieve paper-making process condition control (a web product grade change control) in an on-line mode by using the conventional method of simulation.

A method of simulation of moisture content in accordance with the present invention and web product grade change control using moisture content determined by the method of simulation is based on an assumption that a temperature distribution in the circumference of a steam-heated drum is substantially uniform and the temperature difference between points on the circumference of the steam-heated drum is negligible.

According to the present invention, it is assumed that the temperature variation of a point on the circumference portion of the steam-heated drum is very small during the normal operation of the steam-heated drum even if the circumference has a section in contact with the web and a section not in contact with the web because the steam-heated drum rotates at a high rotating speed. The temperature difference between the above-mentioned two sections estimated by the conventional simulation of the steam-heated drum was about 1° C. or below and the temperatures of points on the same circumference of the steam-heated drum differ scarcely from each other. The simulation of the moisture content of the web in accordance with the present invention and paper-making process condition control using the results of simulation are based on the following assumptions.

$$dT_1/dx = 0$$

where $T_1$ is the temperature of the drum, x is the distance of travel of a point on the circumference of the drum, dx=d (V·t), V is the surface speed of the drum, and t is time.

It is assumed for the present time that "V" is constant.

Therefore, $$dT_1/d(V\cdot t)=(1/V)\cdot(dT_1/dt)=0$$

$$dT_1/dt=0$$

Therefore, equation (1) is:

$$(L_D\cdot\rho_D\cdot C_W)\cdot dT_1/dt=[h_S\cdot(T_S-T_1)-h_{DW\cdot(T1}-T_2)]=0$$

and then, $$T_1=(h_S\cdot T_S+h_{DW\cdot T)/(hS}+h_{DW}) \quad (4)$$

Heat balance equation (2) is rewritten in a forward difference equation:

$$dT_2/dt=(T_{2(Now)}-T_{2(OLD)}/\Delta t\ T_{2(NOW)}=T_{2(OLD)}+[\Delta t/(L_W\cdot\rho_W\cdot C_W)]\cdot[h_{DW\cdot T1(NOW)}-(h_{DW}+h_{DF})\cdot T_{2(OLD)}+h_{WF\cdot T3(NOW)}-V\cdot K\cdot(P_W-P_{ad})\cdot H] \quad (5)$$

and heat balance equation (3) is rewritten in a forward difference equation:

$$dT_3/dt=(T_{3(Now)-T3(OLD)})/\Delta t\ T_{3(NOW)}=T_{3(OLD)}+[\Delta t/(L_F\cdot\rho_F\cdot C_F]\cdot[h_{WF}\cdot T_{2(NOW)}-(h_{WF}+h_a)\cdot T_{3(OLD)}+h_a\cdot T_a] \quad (6)$$

where the "NOW" is a subscript indicating the value of the corresponding variable after a time $\Delta t$ from the time "OLD".

As mentioned above, since the present invention is based on an assumption: $dT_1/dt=0$, a term in Equation (1), indicating the effect of the heat capacity of the drum, i.e., $(L_D\cdot\rho_{D\cdot CD})$ is neglected.

Although no significant problem arises in the calculation of conditions even if the term, $(L_D\cdot\rho_D\cdot C_D)$ is neglected when calculating conditions in a steady state, the variation of the temperature of the drum cannot be expressed only by the aforesaid model in the dynamic simulation of the unsteady state in which the temperature of the drum varies with a time lag when the steam pressure for the drum is changed or the web speed is changed when changing the web product grade. Since the effect of the term, $(L_D\cdot\rho_D\cdot C_D)$ is not disregardable, the aforesaid problem is solved by combining a model expressed by a first-order lag function, which is shown below, with the aforesaid model to calculate the temperature of steam so that the drum pressure varies asymptotically with a time lag when the pressure of steam is changed in the simulation of a unsteady state.

$$T_{S(NOW)}=f(P_{(OLD)}+[1-\exp\{(-(t-t_{(DEAD)})\}/\tau_0]\cdot[f(P_{(NOW)})-f(P_{(OLD)})] \quad (7)$$

where $t_{(DEAD)}$ is a simple time lag in response, $\tau_0$ is time constant and f is reduction function for converting a pressure of steam to a corresponding temperature.

A model in accordance with the present invention is based on an assumption that the amount of moisture evaporating from the web is approximately proportional to a difference between saturated vapor pressure at a temperature of the web and that at a temperature of the ambient air as expressed by an equation shown below. However, a more precise model may be used. For example, more precisely, the rate of evaporation of moisture from the web is dependent on the difference between water vapor concentration at the temperature of the web and that at the temperature of the ambient air. The moisture content of the web may be calculated by using such a more precise model.

$$W=V\cdot K\cdot(P_W-P_{ad})\ \Delta t \quad (8)$$

where W is the amount of moisture ($H_2O$ kg/cm$^2$) evaporated from the web into the ambient air, $\Delta t$ is a time for which the web is subjected to drying process, i.e., the time interval between calculation cycles. Equation (8) is part of Equations (2) and (5).

The moisture content of the web is updated on the basis of calculated values calculated by using the foregoing equations every time the calculation cycle is completed by using:

$$M_{(NOW)}=M_{(OLD)}-\Psi(W) \quad (9)$$

where M is the moisture content of the web, $\Psi(W)$ is a reduction function for reducing an amount of moisture into a moisture content of the web.

As shown in FIG. 3 and 4, the paper-making process condition control apparatus according to the present invention includes a high-speed microcomputer 100 operatively connected to the BM control unit 98 of the conventional BM measuring system, and includes a manually input means, e.g., a keyboard 102, and an appropriate display unit, e.g., a CRT (not shown).

Figure 7:
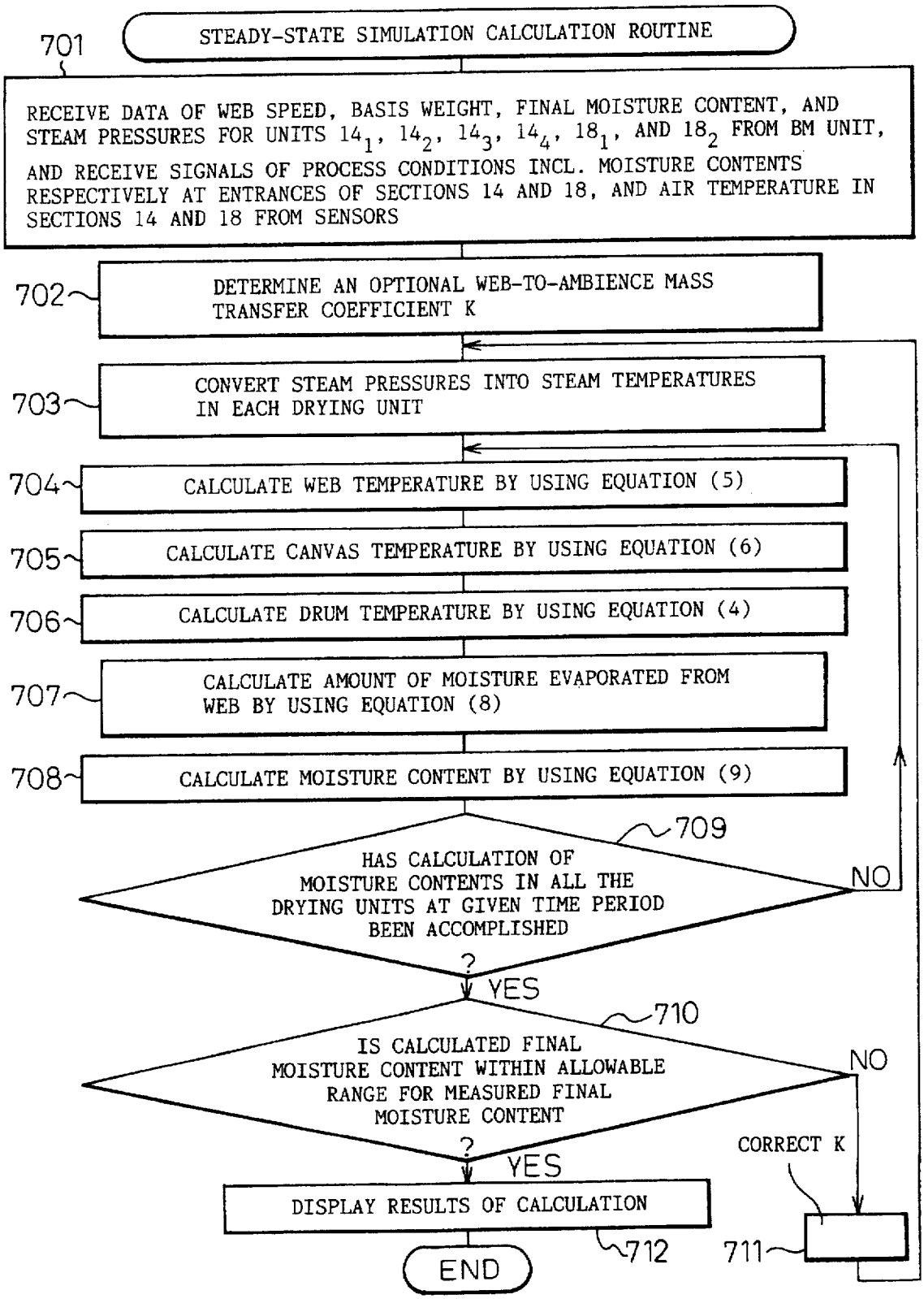
FIG. 7 is a flow chart of a steady-state simulation method in accordance with the present invention.

In accordance with the present invention, the steady state operation of the paper machine is simulated by a simulation routine shown in FIG. 7.

In step 701, the microcomputer 100 reads process conditions including the web speed, the basis weight and the desired moisture content of the web, i.e., data provided by the detecting units 94 and 96, steam pressures of steam in the steam-heated drums of the drying units $\mathbf{14_1}$, $\mathbf{14_2}$, $\mathbf{14_3}$, $\mathbf{18_1}$ and $\mathbf{18_2}$, data representing the moisture content of the web at the entrance of the drying section 14, the air temperatures of the drying sections 14 and 18, and such detected by sensors, not shown. An optional web-to-ambient mass transfer coefficient K is determined in step 702, and the steam pressures in the drying units $\mathbf{14_1}$, $\mathbf{14_2}$, $\mathbf{14_3}$, $\mathbf{18_1}$ and $\mathbf{18_2}$ are converted into corresponding steam pressures in step 703.

In steps 704, 705 and 706, the temperature of the web "WE", the temperatures of the canvas belts **14*b* and 18*b*, and the temperatures of the steam-heated drums 14*a* and 18*b* at positions in the drying units $\mathbf{14_1}$, $\mathbf{14_2}$, $\mathbf{14_3}$, $\mathbf{18_1}$ and $\mathbf{18_2}$ are calculated by using equations (5), (6) and (4), respectively. In step 707, the amount of evaporation from the web "WE" is calculated by using the calculated temperatures and Equation (8), and then the moisture content of the web "WE" is calculated by using Equation (9) in step 708**.

Figure 8:
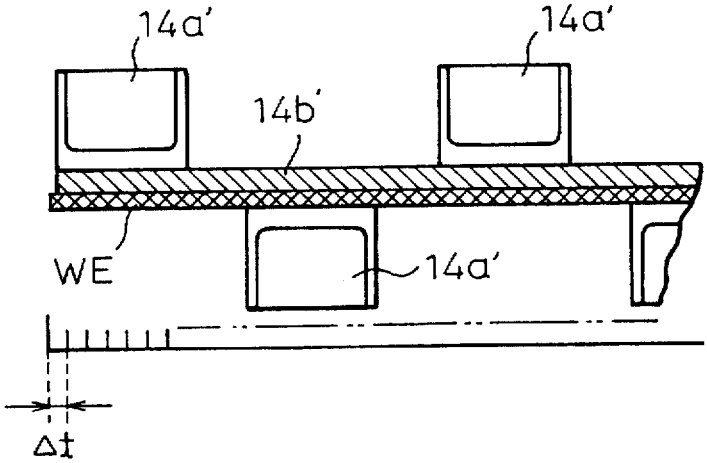
FIG. 8 is a typical view for assistance in explaining the flow chart of FIG. 7.
Figure 9A:
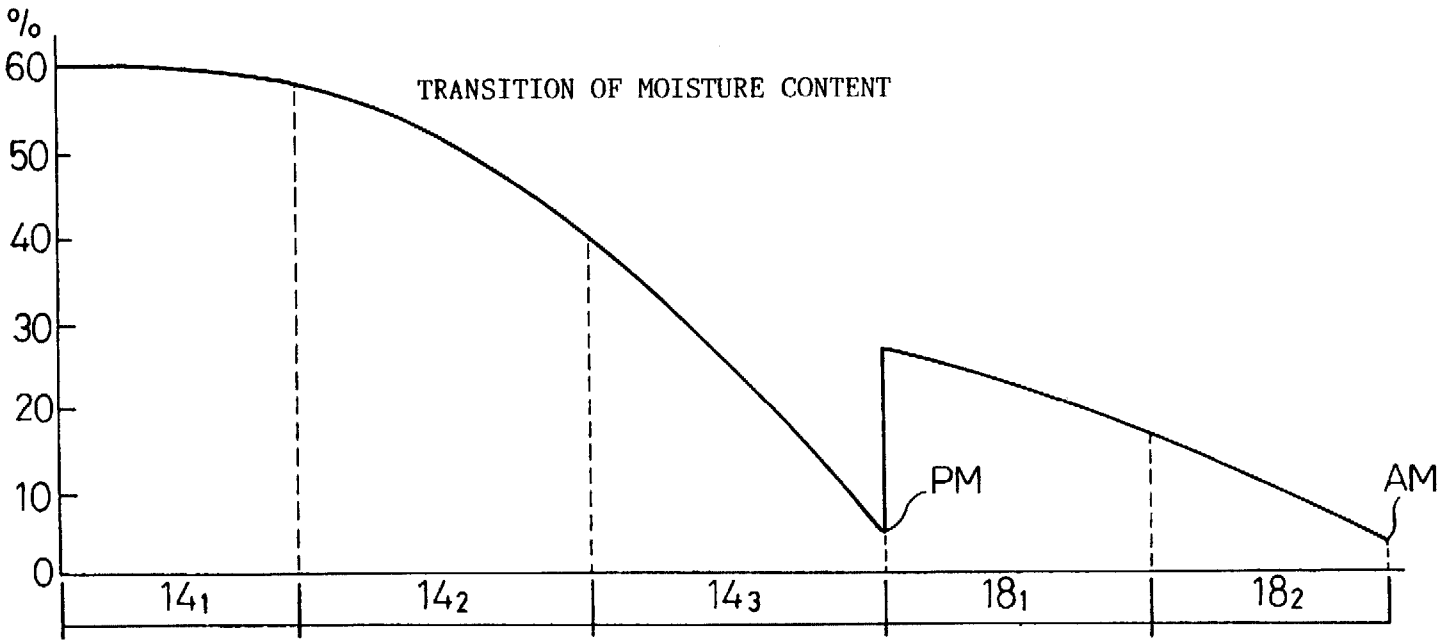
FIG. 9A is a graph showing a moisture content transition pattern obtained by the steady-state simulation method of FIG. 7.

In step 709, a query is made to see whether the moisture content of the web WE in the drying units $\mathbf{14_1}$, $\mathbf{14_2}$, $\mathbf{14_3}$, $\mathbf{18_1}$ and $\mathbf{18_2}$ of all the drying sections has been calculated at the given time period. More specifically, as shown in FIG. 8, the moisture content of the web "WE" is calculated at an infinitesimal time period $\Delta t$, e.g., approximately 20 msec, by using the model shown in FIG. 6. A moisture content transition pattern as shown in FIG. 9 is obtained when the calculation cycle is repeated at the time period $\Delta t$ for all the drying units $\mathbf{14_1}$, $\mathbf{14_2}$, $\mathbf{14_3}$, $\mathbf{18_1}$ and $\mathbf{18_2}$.

In step 710, moisture content data on the aforesaid calculated moisture content transition pattern are compared with measured moisture content data. A moisture content PM (FIG. 9A) of the web "WE" immediately after the web "WE" has passed through the predrying section 14 is compared with an actually measured moisture content of the web "WE" measured by the first detecting unit 94 of the BM measuring system, and a moisture content PM (FIG. 9A) of the web "WE" immediately after the web "WE" has passed through the afterdrying section 18 is compared with a measured moisture content of the web "WE" measured by the second detecting unit 96 of the BM measuring system. If the difference determined by the comparison is beyond an allowable range, the web-to-ambient mass transfer coefficient K is corrected in step 711. Then, the simulation using the model shown in FIG. 6 is repeated. If the difference determined by the comparison is within the allowable range, the results of simulation are displayed on the CRT of the microcomputer 100 in step 712.

Generally, a time on the order of five minutes is necessary to accomplish the conventional steady-state simulation method requiring the convergent calculation needs, however, the present invention is capable of accomplishing the steady-state simulation method in about one to two seconds.

Figure 9B:
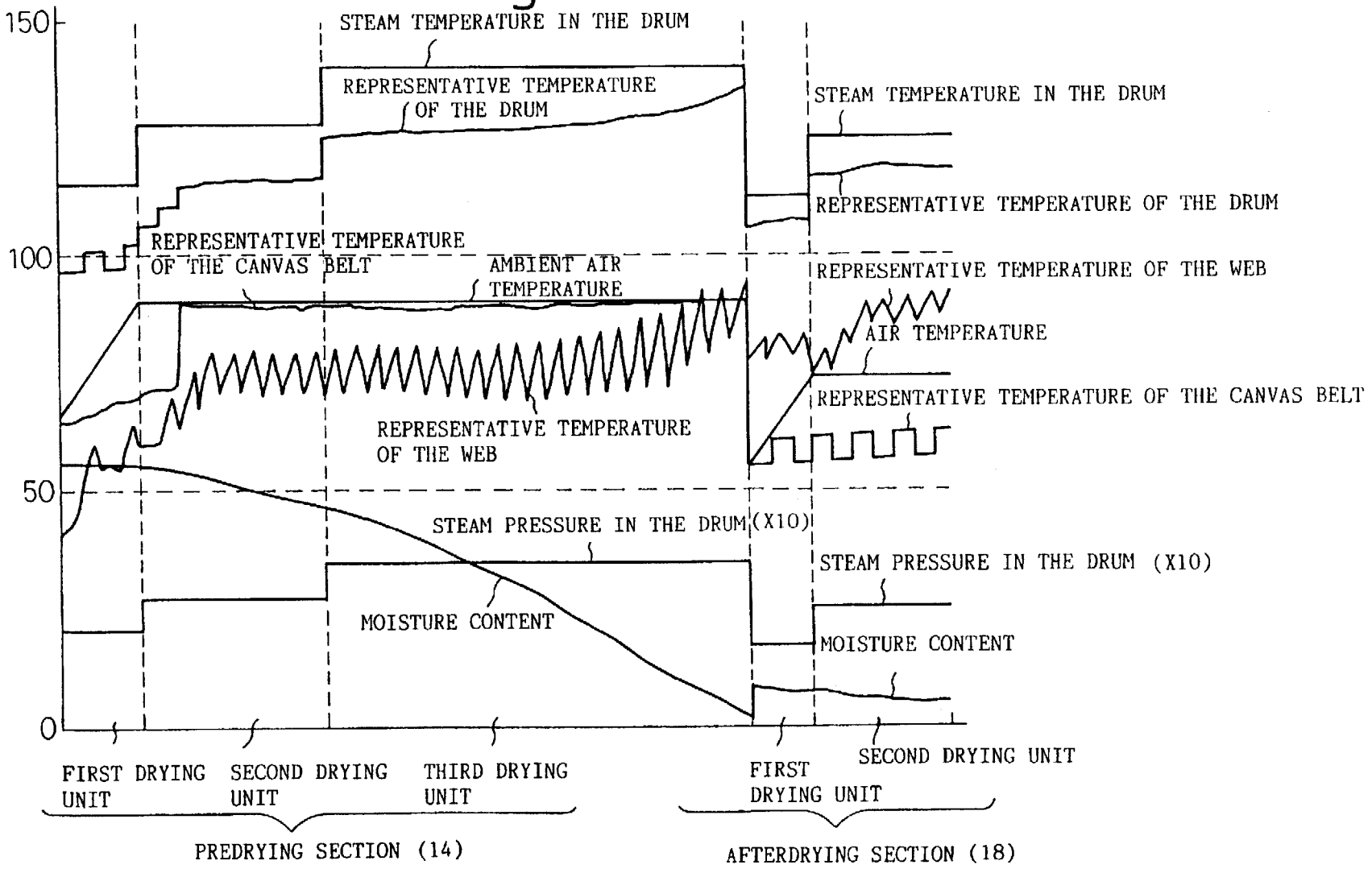
FIG. 9B is a diagram showing calculated results obtained by applying the steady-state simulation method of the present invention to a practical process.

FIG. 9B is a diagram showing calculated results obtained by applying the steady-state simulation method of the present invention to a practical process.

Calculations for obtaining the calculated results shown in FIG. 9B were carried out under the following conditions.

Paper-making speed: 851 m/min

Basis weight (before sizing): 61.0 g/m$^2$

Basis weight (after sizing): 68.0 g/m$^2$

Size (pigment) pickup: 7.08 g/m$^2$

Steam pressure for predrying section

Third drying unit: 3.5 kg/cm$^2$·abs.

Second drying unit: 2.9 kg/cm$^2$·abs.

First drying unit: 2.3 kg/cm$^2$·abs.

Steam pressure for afterdrying section

Second drying unit: 2.4 kg/cm$^2$·abs.

First drying unit: 1.6 kg/cm$^2$·abs.

Figure 10:
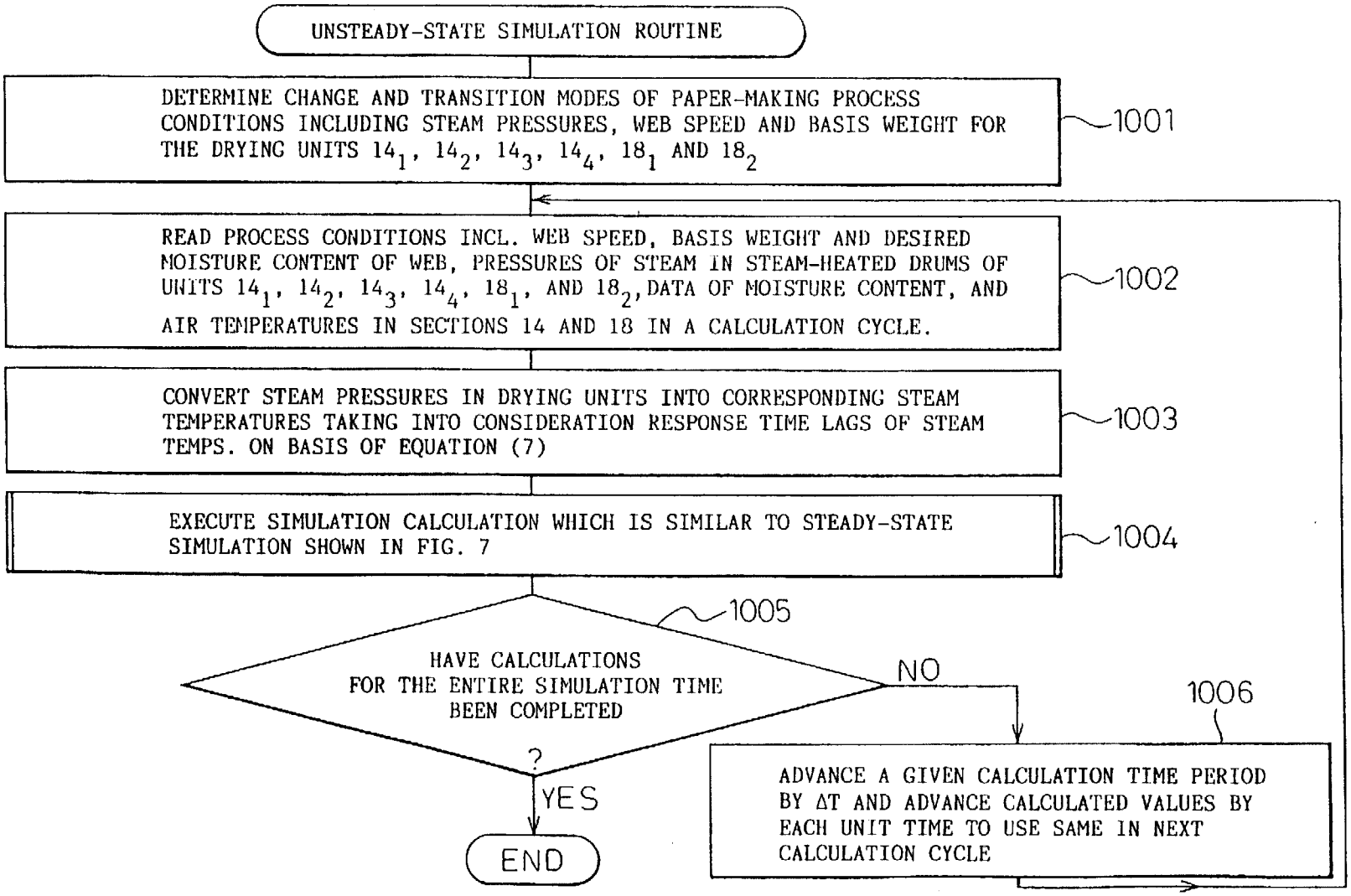
FIG. 10 is a flow chart of a unsteady-state simulation method in accordance with the present invention.

In accordance with the present invention, an unsteady-state simulation routine as shown in FIG. 10 is executed to simulate an unsteady state, such as a state where the paper-making process conditions of the paper machine (basis weight, web speed and such) are changed. The simulation of such an unsteady state corresponds to changing a moisture content transition pattern $MP_1$ shown in FIG. 11 obtained by simulation at a time point during the operation of the paper machine in a steady state to a web moisture content transition pattern $MP_2$ shown in FIG. 11.

In step 1001, changing modes of paper-making process conditions including steam pressures, web speeds and basis weights for the drying units $14_1$, $14_2$, $14_3$, $18_1$ and $18_2$ are determined. The changing modes are selectively determined according to variations in the basis weight and the web speed.

In step 1002, the microcomputer 100 reads process conditions including the web speed, the basis weight and the desired moisture content of the web, i.e., data provided by the detecting units 94 and 96, the pressures of steam in the steam-heated drums of the drying units $14_1$, $14_2$, $14_3$, $18_1$ and $18_2$, data representing the moisture content of the web at the entrance of the drying section 14, the air temperatures in the drying sections 14 and 18, and such, in a calculation cycle.

In step 1003, the steam pressures of steam in the drying units $14_1$, $14_2$, $14_3$, $18_1$ and $18_2$ are converted into corresponding steam temperatures taking into consideration time lags, in response of the steam temperatures, in the drying units on the basis of Equation (7).

Figure 11:
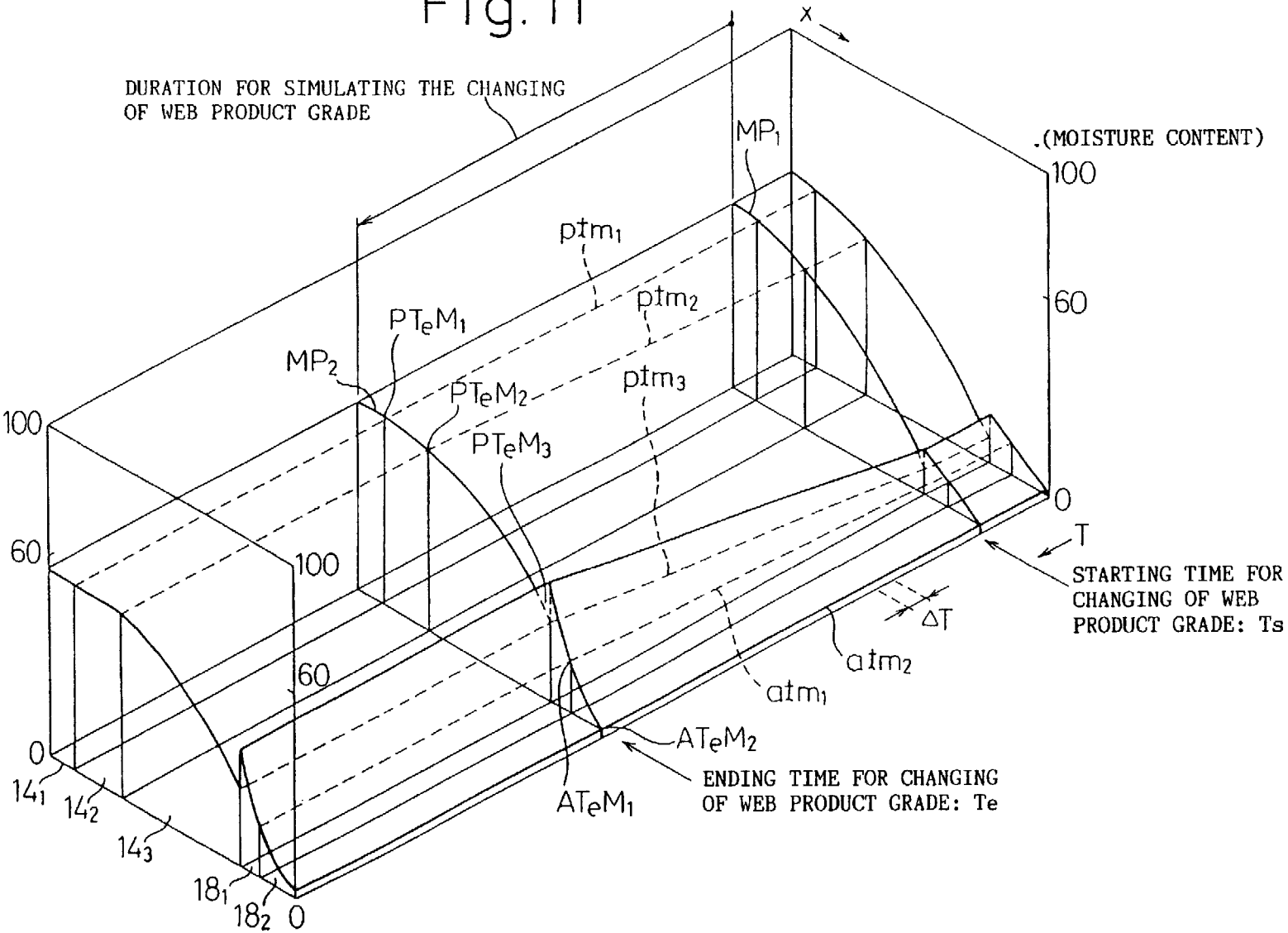
FIG. 11 is a three-dimensional graph showing, by way of example, the progress of the unsteady-state simulation method of the present invention.
Figure 12:
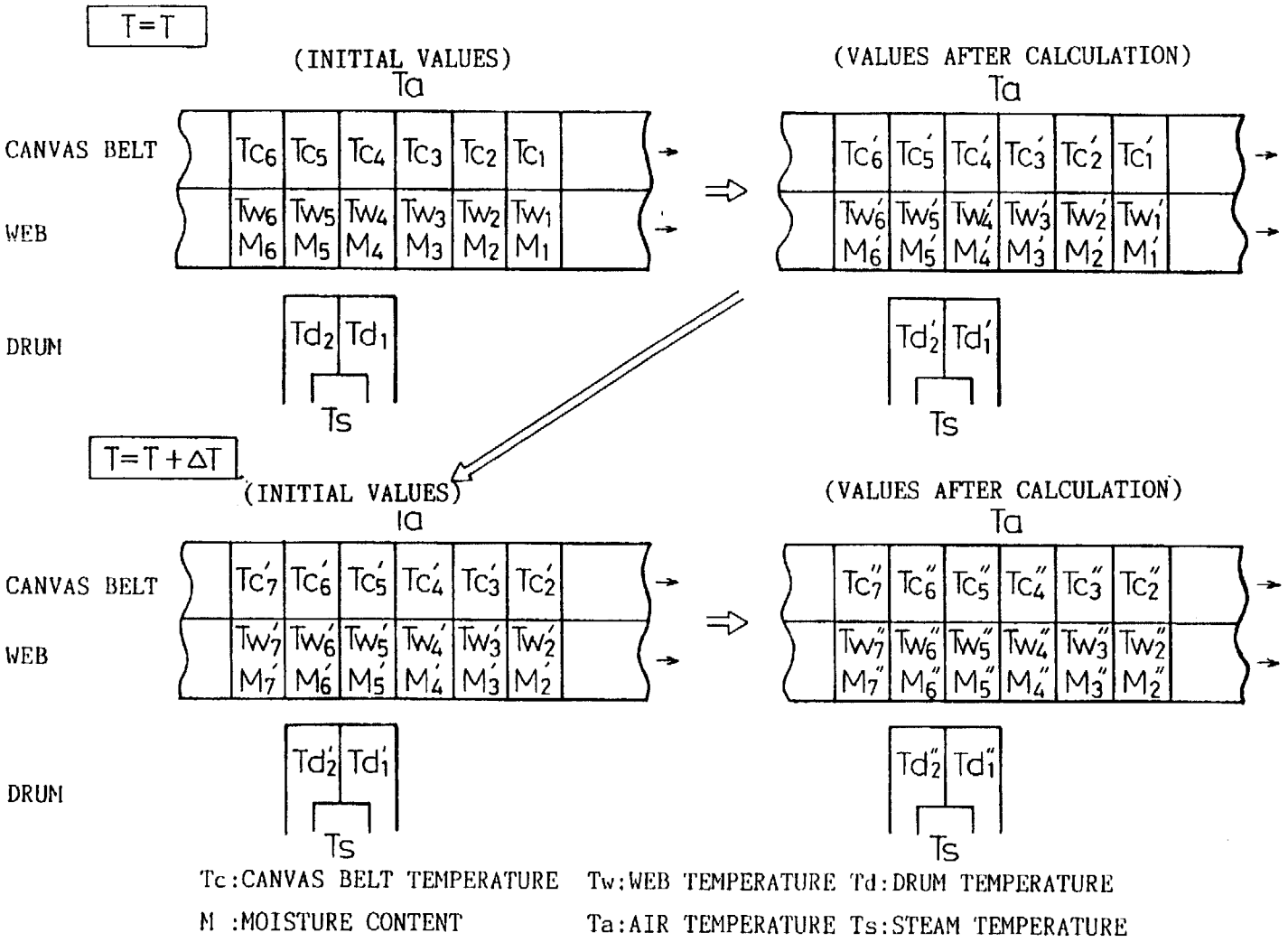
FIG. 12 is a diagrammatic view illustrating calculation to be performed by the unsteady-state simulation method of the present invention.

In step 1004, the steady-state simulation similar to that shown in FIG. 7 is implemented, and a query is made in step 1005 to see whether calculations for the entire simulation time have been completed. If the response to query in step 1005 is negative, a given calculation time period is advanced by ΔT (FIG. 11) in step 1006, and the simulation is repeated. More concretely, suppose, for example, that the distributions of the steam-heated drum temperatures in the drying sections are $Td_1$ and $Td_2$, the distributions of the canvas belt temperatures are $TC_1$ to $TC_6$, the distributions of the web temperatures are $TW_1$ to $TW_6$, and the distributions of the web moisture contents are $M_1$ to $M_6$ as shown in FIG. 12. Then, the unsteady-state simulation is carried out using those data as initial values.

Then, the distributions $Td_1$ and $Td_2$ of the steam-heated drum temperatures change to $Td_1'$ and $Td_2'$, the distributions $Tc_1$ to $Tc_6$ of the canvas belt temperatures change to $Tc_1'$ to $TC_6'$, the distributions $Tw_1$ to $Tw_6$ of the web temperatures change to $TW_1'$ to $Tw_6'$, and the distributions $M_1$ to $M_6$ of the web moisture contents change to $M_1'$ to $M_6'$.

Subsequently, the distributions $Tc_1'$ to $Tc_7'$of the canvas temperatures, the distributions $Tw_1$ to $Tw_7$ of the web temperatures, the distributions $Tw_1'$ to $Tw_7'$of the web moisture contents, and the distributions $M_1'$ to $M_7'$ are shifted by one data relative to the distributions $Td_1'$ and $Td_2'$ of the steam-heated drums, and the unsteady-state simulation is executed again using these data as initial values. Consequently, the distributions $Td_1'$ and $Td_2'$ of the steam-heated drum temperatures change to distributions $Td_1''$ and $Td_2''$, the distributions $Tc_1'$ to $Tc_7'$ of the canvas belt temperature change to $Tc_1''$ to $Tc_7''$, distributions $Tw_1'$ to $Tw_7'$ of the web temperatures change to $Tw_1''$ to $Tw_7''$ and the distributions $M_1'$ to $M_7'$ of the web moisture contents change to $M_1''$ to $M_7''$. Thus, the web moisture content transition pattern $MP_1$ in the drying sections is modified at a time period of ΔT toward the web moisture content pattern $MP_2$ by simulation.

Whereas the conventional unsteady-state simulation method requiring convergent calculations takes about one to two hours to accomplish the unsteady-state simulation, the present invention is able to accomplish the unsteady-state simulation in about one to two minutes.

Figure 13:
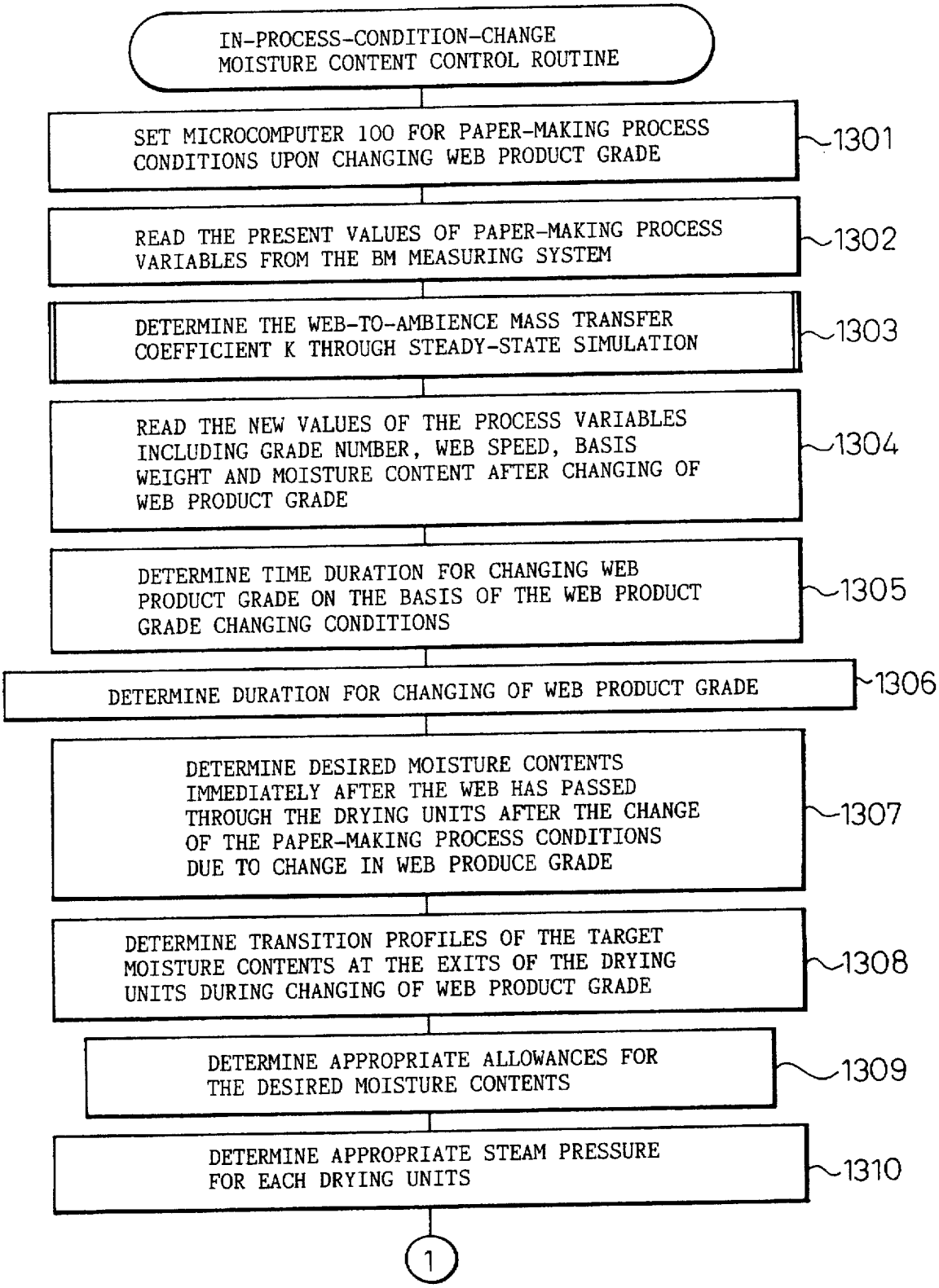
FIG. 13 is part of a flow chart of a moisture content control procedure to be carried out when changing paper-making process conditions.
Figure 14:
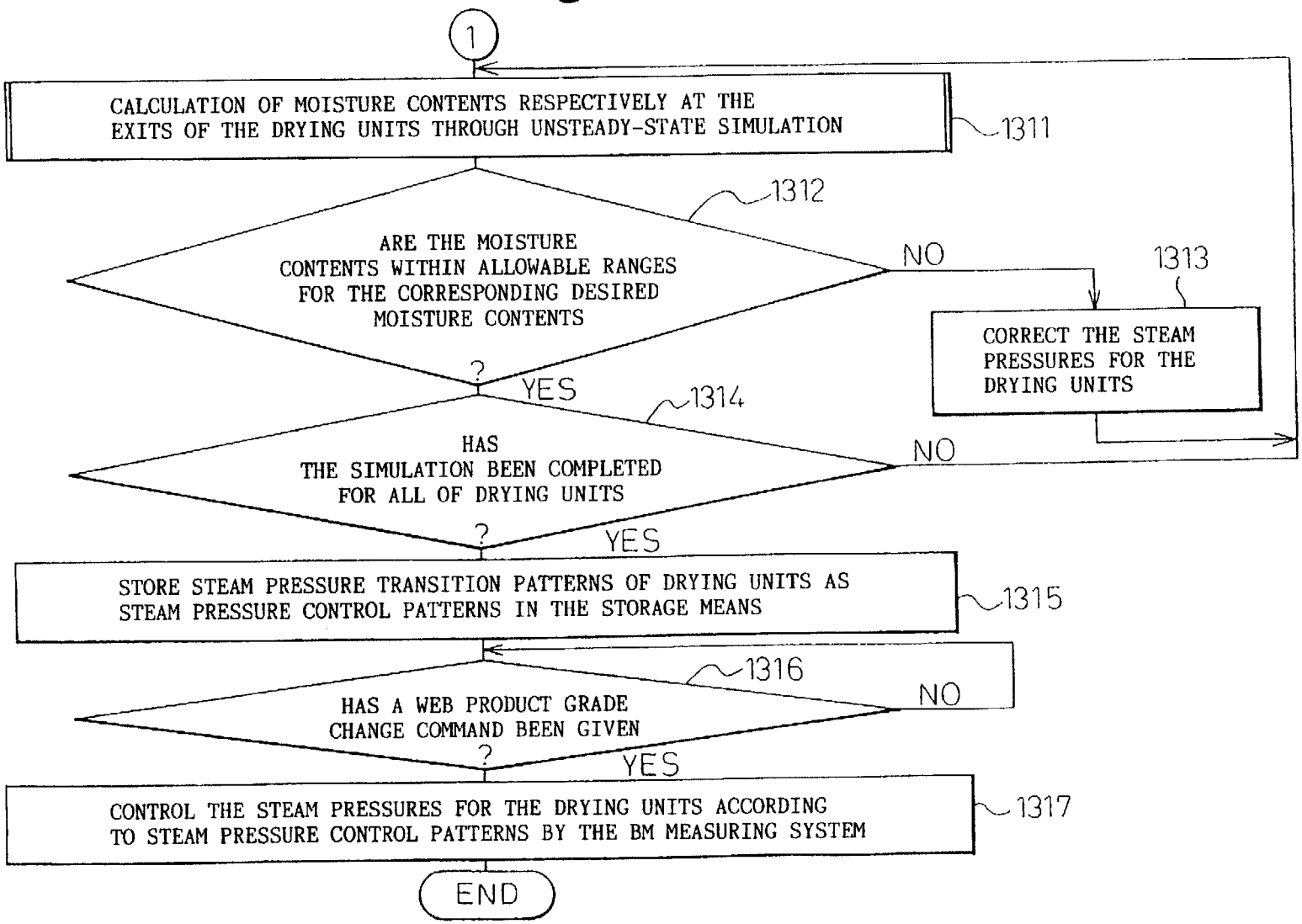
FIG. 14 is another part of the flow chart of the moisture content control procedure continuous with the part shown in FIG. 13.

The operation of the present invention for controlling the moisture content of the web based on the foregoing steady-state simulation and the unsteady-state simulation will be described with reference to a flow chart shown in FIG. 13.

In step 1301, the microcomputer 100 sets paper-making process conditions including a new basis weight, a new web speed, a new final moisture content of the web and such. The microcomputer 100 reads the present values of paper-making process variables of the paper machine from the BM measuring system in step 1302, and then the steady-state simulation (FIG. 7) is carried out on the basis of the present values of the process variables in step 1303 to determine the web-to-ambient mass transfer coefficient K.

In step 1304, the new values of the process variables including grade number, web speed, basis weight, moisture content and such after the change of the paper-making process conditions are read, and then paper-making process time is determined in step 1305 on the basis of the paper-making process conditions; that is, modes of transition with time of process variables including web speed and basis weight are determined on the basis of the paper-making process conditions.

Desired moisture contents of the web "WE" immediately after the web has passed through the drying units $14_1$, $14_2$, $14_3$, $18_1$ and $18_2$ after the change of the paper-making process conditions, i.e., after the change of the web product grade, are determined in step 1307. The desired moisture contents are, for example, $PT_eM_1$, $PT_eM_2$, $PT_eM_3$, $AT_eM_1$ and $AT_eM_2$ as indicated in FIG. 11.

In step 1308, transition profiles $ptm_1$, $ptm_2$, $ptm_3$, $atm_1$ and $atm_2$ (FIG. 11) of the target moisture contents of the web "WE" in the drying units $14_1$, $14_2$, $14_3$, $18_1$ and $18_2$ during the change of the paper-making process conditions are determined. Subsequently, appropriate allowances for the desired moisture contents are determined from the above-mentioned target moisture contents in step 1309.

Steam pressures for the drying units $14_1$, $14_2$, $14_3$, $18_1$ and $18_2$ are set in step 1310. Preferably, the set steam pressures are equal to those read as initial values in step 1301, i.e., the steam pressures used in the preceding paper-making process. The unsteady-state simulation (FIG. 10) is performed sequentially for the drying units at the time of simulation carried out during a web product grade change to determine moisture contents transition patterns in which the moisture content of the web at the respective exits of the drying units change. Then, in step 1312, moisture contents specified by the moisture content transition patterns are compared with the corresponding desired moisture contents. If the difference between the moisture content specified by the moisture content transition pattern and the corresponding desired moisture content is outside an allowance, fine steam pressure adjustment is carried out for the corresponding drying unit in step 1313, and then the unsteady-state simulation is repeated.

A method of fine steam pressure adjustment to be carried out in step 1313 will be described below. The increase of the moisture content of some region of the web beyond the desired moisture content signifies an excessively low steam pressure. When it is thus found that the current steam pressure is excessively low, the simulation is repeated after adding a given steam pressure correction $\Delta p$ to the current set steam pressure. If the correction of the steam pressure reduces the moisture content of the same region of the web below the desired moisture content, it is considered that the steam pressure correction $\Delta p$ is excessively large. Therefore, half the steam pressure correction $\Delta p$, i.e., $\Delta p/2$, is subtracted from the new set steam pressure, and then the simulation is repeated. Thus, the steam pressure correction is reduced by half when the moisture content deviates in the opposite side from the desired moisture content in order that the calculated result fall within the allowable range for the desired moisture content, whereby an appropriate steam pressure can be efficiently determined.

If it is found that the moisture content of the web is within the allowance for the desired moisture content in step 1312, step 1314 is executed to see whether the simulation has been completed for all the drying units $14_1$, $14_2$, $14_3$, $18_1$ and $18_2$. The simulation is repeated at the time period $\Delta t$ (FIG. 11) in the paper-making process condition change simulation time for the drying units.

After the completion of the simulation for all the drying units, part of the results of calculations, i.e., steam pressure transition patterns for the drying units $14_1$, $14_2$, $14_3$, $18_1$ and $18_2$ are stored as steam pressure control patterns in the storage of the microcomputer 100 in step 1315.

Figure 15:
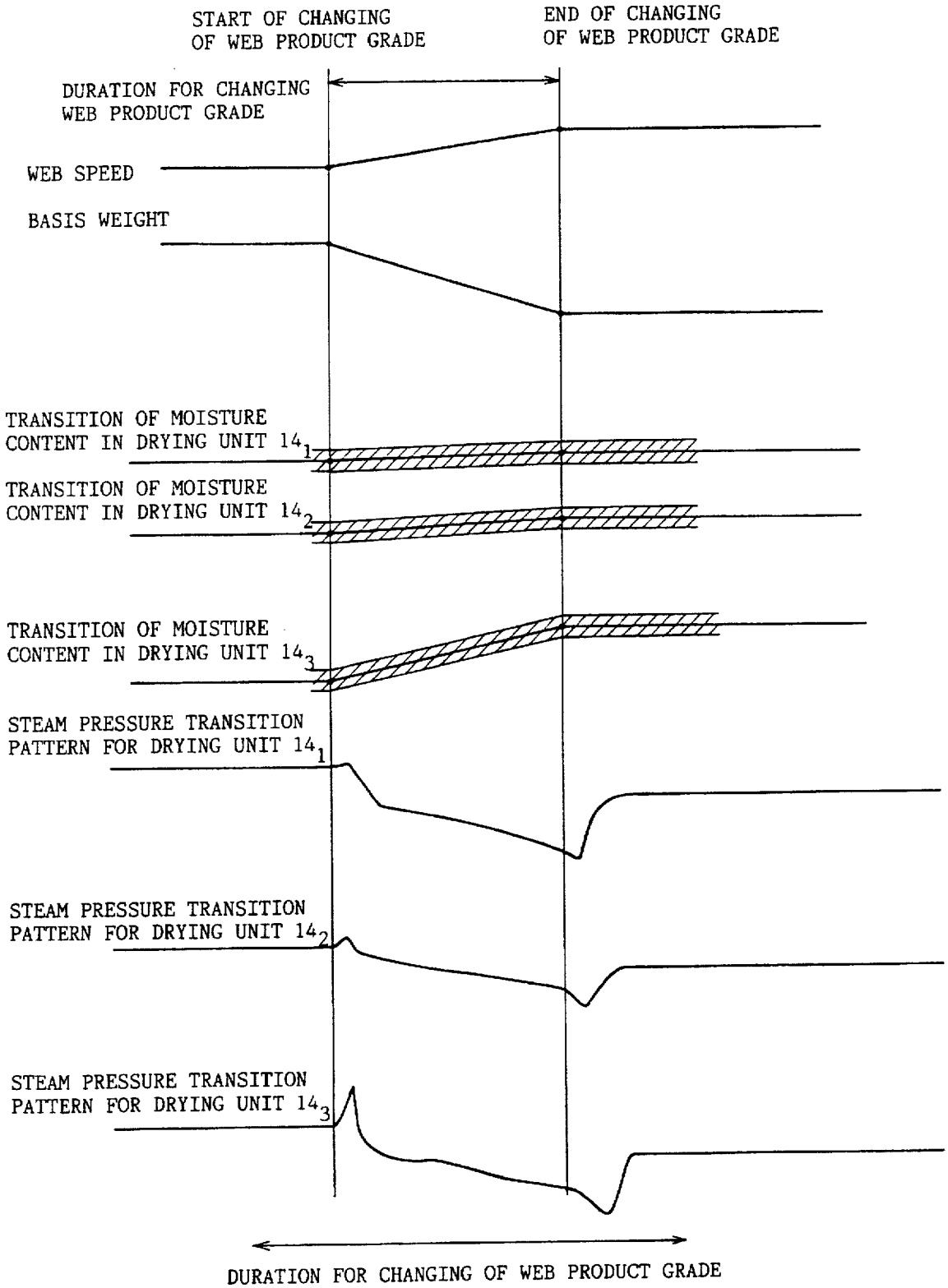
FIG. 15 is a time diagram for assistance in explaining the flow charts of FIGS. 13 and 14.

FIG. 15 is a time diagram which illustrates modes of control of the principal process variables by the foregoing simulation by way of example. In this example, as is obvious from curves in the middle section of FIG. 15, web speed is increased and basis weight is reduced. The moisture content transition patterns (shaded regions indicate allowable ranges) and steam pressure control patterns are shown typically in the lower section of FIG. 15. In FIG. 15, data concerning the drying units of the afterdrying section 18 are omitted.

In step 1316, a query is made to see whether a paper-making process condition change command has been given. The operator operates the input means, such as the keyboard 102, to give the paper-making process condition change command. When the paper-making process condition change command is given, the steam pressures for the drying units $14_1$, $14_2$, $14_3$, $18_1$ and $18_2$ are controlled according to steam pressure control patterns at a given control time period in step 1317 to control the moisture content of the web actually used during the paper-making process condition change.

As can be seen from FIG. 11, the paper-making process condition change simulation time corresponds to a time interval between the start and the end of the paper-making process condition change, i.e., the distance between the moisture content transition patterns $MP_1$ and $MP_2$. However, since a time necessary for adjusting the final moisture content to the desired final moisture content must be allowed for, it is preferable that the actual paper-making process condition change control time is somewhat longer than the paper-making process condition change simulation time as shown in FIG. 15.

As is apparent from the foregoing description, according to the present invention, the steam pressure transition patterns for paper-making process condition change are determined by simulation before the paper-making process condition change is practiced, and the steam pressures in the drying units are controlled according to the steam pressure control patterns during operation for the paper-making process condition change in a predetermined time to obtain a web having a desired moisture content.

Tables (I) and (II) show comparatively the predicted final steam pressures of the steam-heated drums and final steam pressures reached by the application of moisture content control method of the present invention for controlling the moisture content during the paper-making process condition change to an actual paper-making process, and those determined by calculation by the conventional method.

TABLE (I)

| | *3 (m/min) | | *4 (g/m²) | | *5 (%) | | *6 (kg/cm² abs) *7 | | | |
|---|---|---|---|---|---|---|---|---|---|---|
| No. | *1 | *2 | *1 | *2 | *1 | *2 | *1 | *8 | *9 | *10 |
| 1 | 588 | 678 | 91.0 | 80.0 | 4.5 | 4.8 | 4.35 | 2.82 | 4.36 | 4.32 |
| 2 | 716 | 507 | 68.6 | 94.1 | 2.4 | 3.0 | 3.53 | 7.23 | 3.28 | 3.58 |
| 3 | 781 | 780 | 48.1 | 57.1 | 2.0 | 2.2 | 2.46 | 3.38 | 3.11 | 3.43 |
| 4 | 847 | 847 | 53.8 | 49.0 | 2.4 | 2.4 | 3.58 | 3.40 | 3.09 | 2.98 |
| 5 | 834 | 846 | 49.0 | 52.3 | 2.3 | 2.2 | 2.47 | 2.54 | 2.83 | 2.96 |

*1 Before grade change of web product
*2 After grade change of web product
*3 Web speed (m/min)
*4 Basis weight (g/m²) before application of sizing agents
*5 Moisture content (%) before application of sizing agents
*6 Final steam pressure (kg/cm² · abs) in drums of three predryer sections
*7 Predicted value after grade change
*8 Conventional method
*9 Method according to the invention
*10 Actual resultant value

TABLE (II)

| | *11 (g/m²) | | *12 (g/m²) | | *13 (%) | | *14 (kg/cm² abs) *7 | | | |
|---|---|---|---|---|---|---|---|---|---|---|
| No. | *1 | *2 | *1 | *2 | *1 | *2 | *1 | *8 | *9 | *10 |
| 1 | 14.0 | 15.1 | 105.1 | 95.1 | 5.2 | 5.2 | 2.87 | 0.46 | 2.80 | 2.78 |
| 2 | 15.2 | 12.4 | 83.8 | 106.5 | 5.6 | 4.5 | 1.67 | 5.38 | 1.92 | 1.41 |
| 3 | 11.7 | 11.9 | 59.8 | 69.0 | 4.9 | 5.4 | 1.69 | 3.13 | 1.33 | 1.64 |
| 4 | 11.3 | 11.8 | 65.1 | 60.8 | 5.3 | 5.3 | 1.58 | 1.11 | 1.86 | 1.85 |

TABLE (II)-continued

| | *11 (g/m²) | | *12 (g/m²) | | *13 (%) | | *14 (kg/cm² abs) *7 | | | |
|---|---|---|---|---|---|---|---|---|---|---|
| No. | *1 | *2 | *1 | *2 | *1 | *2 | *1 | *8 | *9 | *10 |
| 5 | 2.8 | 2.7 | 51.8 | 55.0 | 5.0 | 4.4 | 1.52 | 1.73 | 1.89 | 1.66 |

*1 Before Grade Change
*2 After Grade Change
*7 Predicted Value After Grade Change
*8 Conventional method
*9 Method according to the Invention
*10 Actual resultant value
*11 Application Amount of Sizing Agents
*12 Basis Weight after Application of Sizing Agents
*13 Final Moisture Content
*14 Final Steam Pressure in Drums of Five Afterdryer Sections As can be seen from Tables (I) and (II), the predicted values predicted by the method of the present invention agree satisfactorily with corresponding final values as compared with the values calculated by the conventional values.

As is apparent from the foregoing description, the present invention is able to simulate the operating condition of the paper machine quickly as compared with the conventional method and is able to adjust the moisture content of the web immediately after the web has passed through each drying section and the final moisture content of the web to desired values, in a comparatively short time.

Thus, the present invention reduces the time necessary for changing the paper-making process conditions, reduces the amount of waste web produced during the paper-making process condition change and contributes to the reduction in the cost of the product as well.

I claim:

1. A method of on-line simulating a moisture content of a web product of a web at a steady state on a paper machine by using a microcomputer, said method comprising the steps of:

passing said web, along with a canvas belt, around each steam-heated drum of a plurality of steam-heated drums of a steam web dryer to dry said web during traveling thereof;

detecting, by detecting units, at least steam pressure in each steam-heated drum of said plurality of steam-heated drums, web basis weight, web traveling speed, and moisture content of said web at a discharge end of said steam web dryer;

describing a heat balance, among all of each steam-heated drum of said plurality of steam-heated drums of said steam web dryer, said web, and said canvas belt, by heat balance equations on an assumption that a temperature distribution in a circumferential portion of each steam-heated drum of said plurality of steam-heated drums is uniform, and reducing said heat balance equations to difference equations;

determining a moisture content transition pattern over an entire drying section of said steam web dryer in a direction of travel of said web by substituting given initial values for elements of said difference equations, and repeatedly solving said difference equations at given times associated with travel of said web, by calculating respective temperatures of all of each steam-heated drum of said plurality of steam-heated drums, said canvas belt and said web, along said direction of travel of said web;

comparing a final moisture content indicated on said moisture content transition pattern with said moisture content actually detected by said detecting units;

deciding whether said final moisture content indicated on said moisture content transition pattern is within a predetermined allowance with respect to said actually detected moisture content; and correcting a web-to-ambient mass transfer coefficient if said final moisture content is not within said predetermined allowance, and repeatedly calculating said moisture content transition pattern until said final moisture content falls within said predetermined allowance with respect to said actually detected moisture content to thereby obtain a steady-state moisture content transition pattern, said steady-state moisture content transition pattern being indicated as an output of simulation.

2. An apparatus for on-line simulating a moisture content of a product of a web product of a web at a steady state on a paper machine by using a microcomputer, said apparatus comprising:

means for passing said web, along with a canvas belt, around each steam-heated drum of a plurality of steam-heated drums of a steam web dryer to dry said web during traveling thereof;

a detecting means for detecting at least steam pressure in each steam-heated drum of said plurality of steam-heated drums, web basis weight, web traveling speed, and moisture content of said web at a discharged end of said steam web dryer;

a storage means for storing difference equations obtained by reducing heat balance equations, describing a heat balance among all of each steam-heated drum of said plurality of steam-heated drums of said steam web dryer, said web, and said canvas belt, on an assumption that a temperature distribution in a circumferential portion of each steam-heated drum of said plurality of steam-heated drums is uniform;

a calculating means both for substituting given initial values for elements of said difference equations stored in said storage means, and for repeatedly solving said difference equations at given times associated with travel of said web, to determine a moisture content transition pattern over a drying section of said steam web dryer in a direction of travel of said web through calculation of respective temperatures of all of each steam-heated drum of said plurality of steam-heated drums, said web and said canvas belt, along said direction of travel of said web;

a comparing means for comparing a final moisture content indicated on said moisture content transition pattern with said moisture content of said web, actually detected at a discharged end of said steam web dryer by said detecting means;

a deciding means for deciding whether said final moisture content indicated on said moisture content transition pattern is within a given allowance with respect to said actually detected moisture content; and a means both for correcting a web-to-ambient mass transfer coefficient if said final moisture content is not within said given allowance, and for repeatedly calculating said moisture content transition pattern until said final moisture content falls within said given allowance to thereby obtain a steady-state moisture content transition pattern, said steady-state moisture content transition pattern being indicated as an output of simulation.

3. A method of on-line simulating a moisture content of a product of a web product of a web in an unsteady state on a paper machine by using a microcomputer, said method comprising the steps of:

passing said web, along with a canvas belt, around each steam-heated drum of a plurality of steam-heated drums of a steam web dryer to dry said web during travel thereof;

varying respective steam pressures of each steam-heated drum of said plurality of steam-heated drums;

describing a heat balance among all of each steam-heated drum of said plurality of steam-heated drums of said steam web dryer, said web, and said canvas belt, by heat balance equations on an assumption that a temperature distribution in a circumference of each steam-heated drum of said plurality of steam-heated drums is uniform, and reducing said heat balance equations to difference equations; and repeatedly calculating a moisture content transition pattern over an entire drying area within said steam web dryer in a direction of travel of said web varying with time at a given time period by using both detected data of said steam pressure in each steam-heated drum of said plurality of steam-heated drums, said web basis weight, said web traveling speed, and said moisture content of said web at a discharge end of said steam web dryer, and said difference equations, while taking into consideration a time lag in response of a temperature of each steam-heated drum of said plurality of steam-heated drums to a variation of said steam pressure for each steam-heated drum of said plurality of steam-heated drums to correct errors attributable to said assumption, said calculated moisture content transition pattern being indicated as an output of an unsteady state simulation.

4. An apparatus for on-line simulating a moisture content of a web product of a web on a paper machine by using a microcomputer, said apparatus comprising:

means for passing said web, along with a canvas belt, around each steam-heated drum of a plurality of steam-heated drums of a steam web dryer to dry said web during travel thereof;

a detecting means for detecting at least steam pressure in each steam-heated drum of said plurality of steam-heated drums, web basis weight, web traveling speed, and moisture content of said web at a discharged end of said steam web dryer;

means for varying respective steam pressures of each steam-heated drum of said plurality of steam-heated drums;

a storage means for storing difference equations obtained by reducing heat balance equations describing a heat balance among all of each steam-heated drum of said plurality of steam-heated drums of said steam web dryer, said web, and said canvas belt, on an assumption that a temperature distribution in a circumference of each steam-heated drum of said plurality of steam-heated drums is uniform;

a calculating means for repeatedly calculating a moisture content transition pattern with respect to a direction of travel of said web in said steam web dryer varying with time at a given time period by using said difference equations, taking into consideration a time lag in a response of a temperature of each steam-heated drum of said plurality of steam-heated drums to a variation of said steam pressure applied to each steam-heated drum of said plurality of steam-heated drums to correct errors attributable to said assumption; and means for indicating said moisture content transition pattern as an output of an unsteady state simulation.

5. A method of adjusting and controlling a moisture content of a web product of a web on a paper machine by using a microcomputer, said method comprising the steps of:

passing said web, along with a canvas belt, around each steam-heated drum of a plurality of steam-heated drums forming a plurality of separate drying areas of a steam web dryer, to dry said web to a desired moisture content by controlling transition of a steam pressure supplied to each steam-heated drum of said plurality of steam-heated drums when changing a grade of said web product on said paper machine;

detecting, by detecting units, at least steam pressure in each steam-heated drum of said plurality of steam-heated drums, web basis weight, web traveling speed, and moisture content of said web at discharge ends of said plurality of separate drying areas;

describing a heat balance among all of each steam-heated drum of said plurality of steam-heated drums of said steam web dryer, said web, and said canvas belt, by heat balance equations on an assumption that a temperature distribution in a circumference portion of each steam-heated drum of said plurality of steam-heated drums is uniform, and reducing said heat balance equations to difference equations;

determining a moisture content transition pattern at a steady state in a direction of travel of said web within said steam web dryer by substituting appropriate initial values for elements of said difference equations and repeatedly solving said difference equations at given times associated with travel of said web until a final moisture content obtained from said moisture content transition pattern falls within a predetermined allowance with respect to said actually detected moisture content;

setting a desired moisture content pattern for each of discharge ends of said plurality of drying areas during predetermined times of changing grade of said web product, on a basis of said determined steady state moisture content transition pattern while introducing paper making process conditions after changing grade of said web product into said microcomputer; and obtaining a moisture content transition pattern at each of said discharge ends of said plurality of drying areas in a direction of travel of said webs during times of changing grade of said web product from varying said steam pressure supplied to each steam-heated drum of said plurality of steam-heated drums at a given time period and repeatedly calculating, by said difference equations, said moisture content transition pattern at a given time period, while taking into consideration an assumptive time lag in a response of a temperature of each steam-heated drum of said plurality of steam-heated drums, and simultaneously producing an associated temporal steam pressure transition pattern of each steam-heated drum of said plurality of steam-heated drums during times of changing grade of said web product, in order to make said moisture content transition pattern at each of said discharge ends of said plurality of drying areas during predetermined times of changing grade of said web product coincide substantially with said desired moisture content pattern within a predetermined allowance; and changing said steam pressure supplied to each steam-heated drum of said plurality of steam-heated drums based upon said steam pressure transition pattern when actually changing said grade of said web product on said paper machine.

6. An apparatus for adjusting a moisture content of a web product of a web on a paper machine by using a microcomputer, said apparatus comprising:

means for passing said web, along with a canvas belt, around each steam-heated drum of a plurality of steam-heated drums forming a plurality of separate drying areas of a steam web dryer to dry said web to a desired moisture content;

a detecting means for detecting at least steam pressure in each steam-heated drum of said plurality of steam-heated drums, web basis weight, web traveling speed, and moisture content of said web at discharge ends of said plurality of separate drying areas;

means for controlling transition of a steam pressure supplied to each steam-heated drum of said plurality of steam-heated drums when changing said grade of said web product on said paper machine;

a storage means for storing difference equations obtained by reducing heat balance equations describing a heat balance among all of each steam-heated drum of said plurality of steam-heated drums of said steam web dryer, said web, and said canvas belt, on an assumption that a temperature distribution in a circumference of each steam-heated drum of said plurality of steam-heated drums is uniform;

a calculating means for calculating a moisture content transition pattern at a steady state in a direction of travel of said web within said steam web dryer by substituting appropriate initial values for elements of said difference equations and repeatedly solving said difference equations at given times associated with travel of said web until a final moisture content obtained from said moisture content transition pattern falls within a predetermined allowance with respect to said actually detected moisture content;

means for introducing paper making process conditions after changing of said grade of said web product into said microcomputer;

a setting means for setting a desired moisture content pattern for each of said discharge ends of said plurality of drying areas during predetermined times of changing said grade of said web product, on a basis of said moisture content transition pattern at a steady state;

a calculating means both for obtaining a moisture content transition pattern at each of said discharge ends of said plurality of drying areas in a direction of travel of said web during times of changing said grade of said web product from varying said steam pressure supplied to each steam-heated drum of said plurality of steam-heated drums at a given time period and from repeatedly calculating, by said difference equations, said moisture content transition pattern at a given time period, while taking into consideration an assumptive time lag in a response of a temperature of each steam-heated drum of said plurality of steam-heated drums, and for simultaneously producing an associated temporal steam pressure transition pattern of each steam-heated drum of said plurality of steam-heated drums during times of changing said grade of said web product, in order to make said moisture content transition pattern at each of said discharge ends of said plurality of drying areas during predetermined times of changing said grade of said web product coincide substantially with said desired moisture content pattern with a predetermined allowance; and means for adjustably changing said steam pressure supplied to said respective stem-heated drums based upon said steam pressure transition pattern when actually changing said grade of said web product on said paper machine.

* * * * *